US008215286B2

(12) United States Patent
Maekawa et al.

(10) Patent No.: US 8,215,286 B2
(45) Date of Patent: Jul. 10, 2012

(54) ELECTRONIC CONTROL SYSTEM FOR CARBURETOR

(75) Inventors: Yoshinori Maekawa, Wako (JP); Keiichiro Bungo, Wako (JP); Yasuhide Ono, Wako (JP); Hayato Matsuda, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 1100 days.

(21) Appl. No.: 11/920,639

(22) PCT Filed: Jun. 23, 2006

(86) PCT No.: PCT/JP2006/312611

§ 371 (c)(1),
(2), (4) Date: Jan. 15, 2008

(87) PCT Pub. No.: WO2006/137522

PCT Pub. Date: Dec. 28, 2006

(65) Prior Publication Data

US 2010/0180864 A1 Jul. 22, 2010

(30) Foreign Application Priority Data

Jun. 23, 2005 (JP) ..... 2005-183608
Jun. 23, 2005 (JP) ..... 2005-183610

(51) Int. Cl.
*F02M 7/24* (2006.01)
*F02D 11/10* (2006.01)

(52) U.S. Cl. ..... 123/438; 123/399

(58) Field of Classification Search ..... 123/41.31, 123/41.86, 439, 442, 437, 698–702, 361, 123/399, 400, 403; 454/184, 250
See application file for complete search history.

(56) References Cited

U.S. PATENT DOCUMENTS

| | | | | |
|---|---|---|---|---|
| 4,974,444 | A * | 12/1990 | Neubacher | 73/114.32 |
| 6,082,343 | A * | 7/2000 | Oishi et al. | 123/572 |
| 6,568,376 | B2 * | 5/2003 | Sonnleitner et al. | 123/559.1 |
| 6,725,833 | B1 * | 4/2004 | Irihune et al. | 123/399 |
| 7,007,666 | B2 * | 3/2006 | Kamimura et al. | 123/399 |
| 7,156,376 | B2 * | 1/2007 | Bungo et al. | 261/64.1 |
| 2001/0042532 | A1 * | 11/2001 | Aichinger et al. | 123/192.1 |
| 2002/0023627 | A1 * | 2/2002 | Nakase et al. | 123/516 |
| 2002/0081919 | A1 * | 6/2002 | Muramatsu et al. | 440/88 |
| 2002/0112696 | A1 * | 8/2002 | Watanabe | 123/432 |
| 2003/0024505 | A1 * | 2/2003 | Anschicks et al. | 123/399 |
| 2003/0075094 | A1 * | 4/2003 | Aoyama | 114/145 R |
| 2004/0067700 | A1 * | 4/2004 | Kinoshita et al. | 440/40 |
| 2004/0069250 | A1 * | 4/2004 | Aichinger et al. | 123/1 A |

(Continued)

FOREIGN PATENT DOCUMENTS

JP 07-139414 A 5/1995

(Continued)

*Primary Examiner* — Willis Wolfe, Jr.
*Assistant Examiner* — Johnny H Hoang
(74) *Attorney, Agent, or Firm* — Arent Fox LLP

(57) ABSTRACT

An electronic control system for a carburetor, includes: a transmission device linked to a valve; an electric actuator for driving the valve; and an electronic control unit for controlling operation of the electric actuator, the electric actuator being disposed between the transmission device and the electronic control unit, The transmission device, the electric actuator and the electronic control unit are housed and held in a casing mounted on the carburetor. A ventilation apparatus which places an interior of the casing in communication with an outside atmosphere relative to the carburetor is connected to the casing.

15 Claims, 19 Drawing Sheets

U.S. PATENT DOCUMENTS

2007/0068465 A1* 3/2007 Wolfsgruber et al. ..... 123/1 A

FOREIGN PATENT DOCUMENTS

JP 2002-357131 12/2002
JP 2004-144039 A 5/2004
JP 2004-239234 A 8/2004
JP 2004-285899 10/2004
WO WO00/58614 A1 10/2000

* cited by examiner

CHOKE VALVE FULLY CLOSED (A)

CHOKE VALVE FULLY OPENED (B)

(A)

RELIEF OPENED VALVE (B)

(A)

(B)

LEVER RATIO BETWEEN RELIEF LEVER AND CHOKE LEVER
(TORQUE ON CHOKE VALVE SHAFT)

ELECTRONIC CONTROL SYSTEM FOR CARBURETOR

CROSS-REFERENCE TO RELATED APPLICATION

This application is a National Stage entry of International Application No. PCT/JP2006/312611, filed Jun. 23, 2006, the entire specification claims and drawings of which are incorporated herewith by reference.

TECHNICAL FIELD

The present invention relates to an electronic control system for a carburetor mainly applied to a general-purpose engine, and particularly to an improvement of an electronic control system for a carburetor, comprising: a transmission device linked to a valve for opening and closing an intake path of a carburetor; an electric actuator for opening and closing the valve via the transmission device; and an electronic control unit for controlling operation of the electric actuator.

BACKGROUND ART

Such an electronic control system for a carburetor is known as disclosed in the following Patent Publication 1.

Patent Publication 1: Japanese Utility Model Laid-Open No. 56-150834.

DISCLOSURE OF THE INVENTION

Problems to be Solved by the Invention

In the conventional electronic control system for a carburetor, a transmission device and an electric actuator are mounted on the carburetor or an engine, separately from an electronic control unit. In order to protect them from external factors, individual casings are required to hinder downsizing of the general-purpose engine which is connected to various types of work machines and used.

The present invention has been achieved in view of the above-mentioned circumstances, and has an object to provide an electronic control system for a carburetor, in which a transmission device, an electric actuator and an electronic control unit can be efficiently housed in a common casing, thereby contributing to downsizing of the casing and thus downsizing of the entirety of an engine including a carburetor.

Means for Solving the Problem

In order to achieve the above object, according to a first feature of the present invention, there is provided an electronic control system for a carburetor, comprising: a transmission device linked to a valve for opening and closing an intake path of a carburetor; an electric actuator for opening and closing the valve via the transmission device; and an electronic control unit for controlling operation of the electric actuator, characterized in that the transmission device, the electric actuator and the electronic control unit are housed and held in a casing mounted on the carburetor; and ventilation means for causing an interior of the casing to communicate with the outside is connected to the casing.

The valve, the electric actuator and the transmission device corresponds, respectively, to a choke valve 7 and a throttle valve 8, first and second electric motors 20 and 21, and first and second transmission devices 24 and 25 of an embodiment of the present invention which will be described later.

According to a second feature of the present invention, in addition to the first feature, the casing comprises a casing main body mounted on the carburetor and housing the transmission device and the electric actuator, and a lid body for closing an open surface of the casing main body; the lid body comprises a cover connected to the casing main body, and the electronic control unit sandwiched between the cover and the casing main body; and a gap is provided between opposed surfaces of the cover and the electronic control unit so that the gap communicates with the atmosphere through the ventilation means.

According to a third feature of the present invention, in addition to the second feature, the ventilation means comprises an air passage extending in the shape of a hook from the gap and opening to the atmosphere with its outer end facing downward.

According to a fourth feature of the present invention, in addition to the second or third feature, the electronic control unit comprises a board on which an electronic control circuit is provided by print-wiring and which is arranged to close the open surface of the casing main body, and various types of electronic components mounted on a surface of the board facing an interior of the casing main body.

According to a fifth feature of the present invention, in addition to the fourth feature, a hot-melt coating is formed on the surfaces of the board and the various types of electronic components so as to cover them.

According to a sixth feature of the present invention, in addition to the first feature, the ventilation means is connected to a base part of the interior of the casing.

According to a seventh feature of the present invention, in addition to the sixth feature, the ventilation means comprises vents bored in the carburetor and causing the base part of the interior of the casing to communicate with the intake path of the carburetor.

According to an eighth feature of the present invention, in addition to the seventh feature, an outer end of the vent is opened to a bearing hole of the carburetor supporting a choke valve shaft.

According to a ninth feature of the present invention, in addition to the sixth feature, at least a part of the ventilation means comprises a labyrinth which is formed on opposed surfaces of the carburetor and an adjacent member joined thereto and which is opened to the atmosphere with its outer end facing downward.

The adjacent member corresponds to a cylinder head 3*a* of the embodiment of the present invention which will be described later.

Effect of the Invention

With the first feature of the present invention, the electronic control system for a carburetor is constituted by housing, in a common casing, the transmission device, the electric actuator and the electronic control unit. Therefore, it is possible to downsize the electronic control system, and thus downsizing the entirety of the engine including the carburetor on which the electronic control system is mounted.

Further, the interior of the casing communicates with the outside through the ventilation means, so that the interior of the casing can breathe when the air inside the casing is expanded or contracted due to heat generation and heat dissipation of the electric actuator or due to heating and cooling of the casing caused with temperature change of the engine. Therefore, it is possible to prevent an excessive pressure from acting on the electronic control unit and the electric actuator, and also prevent dew condensation on the electronic control unit and the electric actuator by such breathing, thereby improving durability of the electronic control unit and the electric actuator.

With the second feature of the present invention, the casing comprises the casing main body mounted on the carburetor and housing the transmission device and the electric actuator, and the lid body for closing the open surface of the casing main body; and the lid body comprises the cover connected to the casing main body, and the electronic control unit sandwiched between the cover and the casing main body. Therefore, it is possible to simplify the support structure of the electronic control unit.

Further, the gap communicating with the atmosphere through the ventilation means is provided between the opposed surfaces of the cover and the electronic control unit, so that the gap can breathe when the air between the cover and the electronic control unit is expanded or contracted due to heat generation and heat dissipation of the electronic control unit or due to heating and cooling of the cover with temperature change of the engine. Therefore, it is possible to prevent an excessive pressure from acting on the electronic control unit, and also prevent dew condensation on the electronic control unit by such breathing, thereby improving durability of the electronic control unit.

With the third feature of the present invention, the ventilation means for securing the breathing by the gap comprises the air passage extending in the shape of a hook from the gap, and opening to the atmosphere with its outer end facing downward. Therefore, it is difficult for rainwater or the like to enter the gap through the air passage. Even if rainwater or the like enters the gap, it can easily be discharged from the air passage.

With the fourth feature of the present invention, the various types of electronic components are mounted on a surface, facing the interior of the casing main body, of the board of the electronic control unit, thereby housing the various types of electronic components in the casing together with the electric actuator and the transmission device. Thus, the space in the casing is efficiently used, thereby contributing to downsizing of the casing.

With the fifth feature of the present invention, the board and the various types of electronic components are sealed by the hot-melt coating formed on the surfaces thereof, and also the sealing between the lid body and the casing main body is in a good condition. Further, the hot-melt coating is formed with a uniform thickness along the surfaces of the board and the various types of electronic components without any wasteful thick part. Thus, it is easy to avoid mutual interference between the various types of electronic components and the electric actuator.

With the sixth feature of the present invention, the base part of the interior of the casing communicates with the outside through the ventilation means so that the interior of the casing can breathe. Therefore, it is possible to prevent an excessive pressure from acting on the electronic control unit and the electric actuator, and also prevent dew condensation on the electronic control unit and the electric actuator by such breathing. Further, even if water droplets generated due to dew condensation accumulate in the base part of the casing, they can be naturally drawn out to the intake path.

With the seventh feature of the present invention, the intake negative pressure generated in the intake path during operation of the engine acts on the interior of the casing through the vent. Therefore, even if water droplets generated due to dew condensation accumulate in the base part of the casing, they can be naturally drawn out to the intake path.

Further, the vent communicates with the intake path, providing no fear of sucking in outside dust when the interior of the casing breathes.

With the eighth feature of the present invention, even if the vent has a large diameter, its open end is constricted between an inner periphery of the bearing hole and the outer periphery of the choke valve shaft fitted into the bearing hole. Therefore, it is possible to prevent fuel contained in some amount in blow-back gas from entering the vent when the engine blows back.

With the ninth feature of the present invention, the interior of the casing communicates with the atmosphere through the labyrinth to be capable of breathing therethrough. Further, the labyrinth opens in the atmosphere with its outer end facing downward so as not to easily allow rainwater or dust to enter the labyrinth. Even if the rainwater or dust enters, it naturally flows down to be discharged to the outside.

The above-mentioned object, other objects, characteristics and advantages of the present invention will become apparent from a preferred embodiment, which will be described in detail below by reference to the attached drawings.

EXPLANATION OF THE REFERENCE NUMERALS AND SYMBOLS

Figure 1:
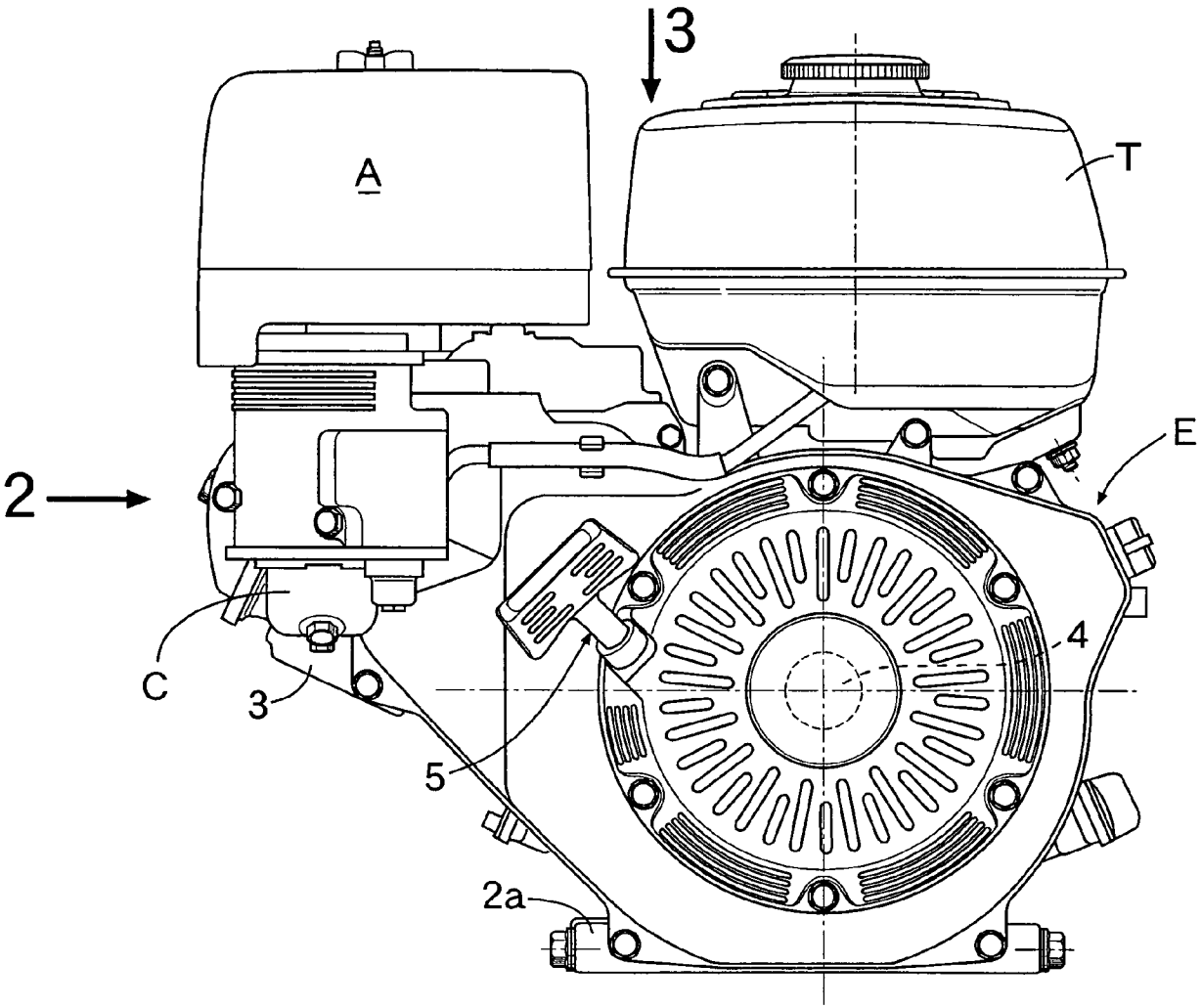
FIG. 1 is a front view of a general-purpose engine according to an embodiment of the present invention. (first embodiment)

C carburetor
D electronic control system
3*a* adjacent member of carburetor
6 intake path
7 valve (choke valve)
7*a* choke valve shaft
8 valve (throttle valve)
10 casing
11*a* casing main body
12 lid body
12*a* electronic control unit
12*b* cover
20 electric actuator (first electric motor)
21 electric actuator (second electric motor)
24 transmission device (first transmission device)
25 transmission device (second transmission device)
50 board
51 to 54 various types of electronic components
57 coating
70 gap
72 air passage
74 ventilation means (vent)
74' ventilation means (vent)
77 bearing hole
89, 92 ventilation means (vent, labyrinth)

BEST MODE FOR CARRYING OUT THE INVENTION

A preferred embodiment of the present invention will be described below with reference to the accompanying drawings.

Embodiment 1

Figure 2:
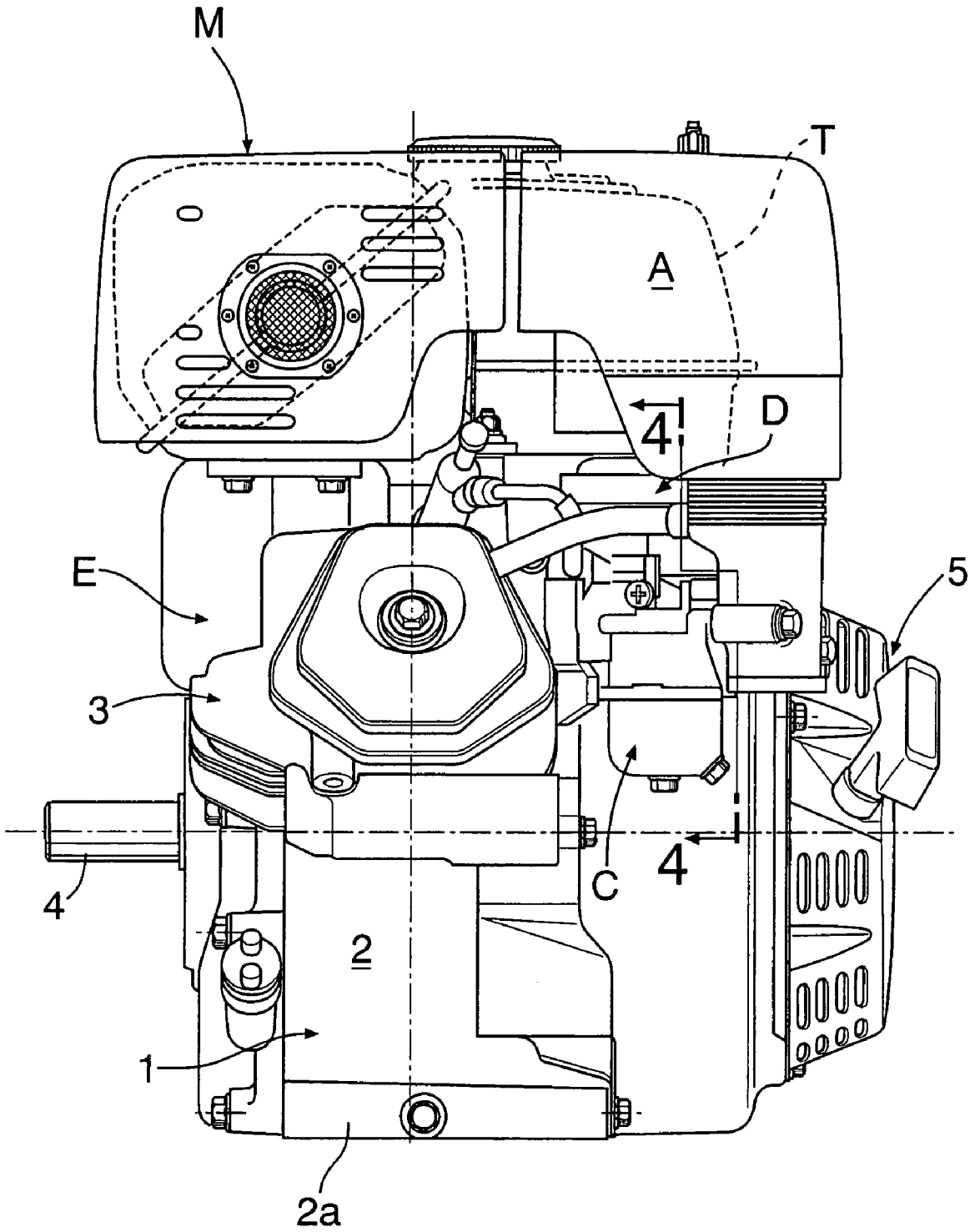
FIG. 2 is a view from arrow 2 in FIG. 1. (first embodiment)
Figure 3:
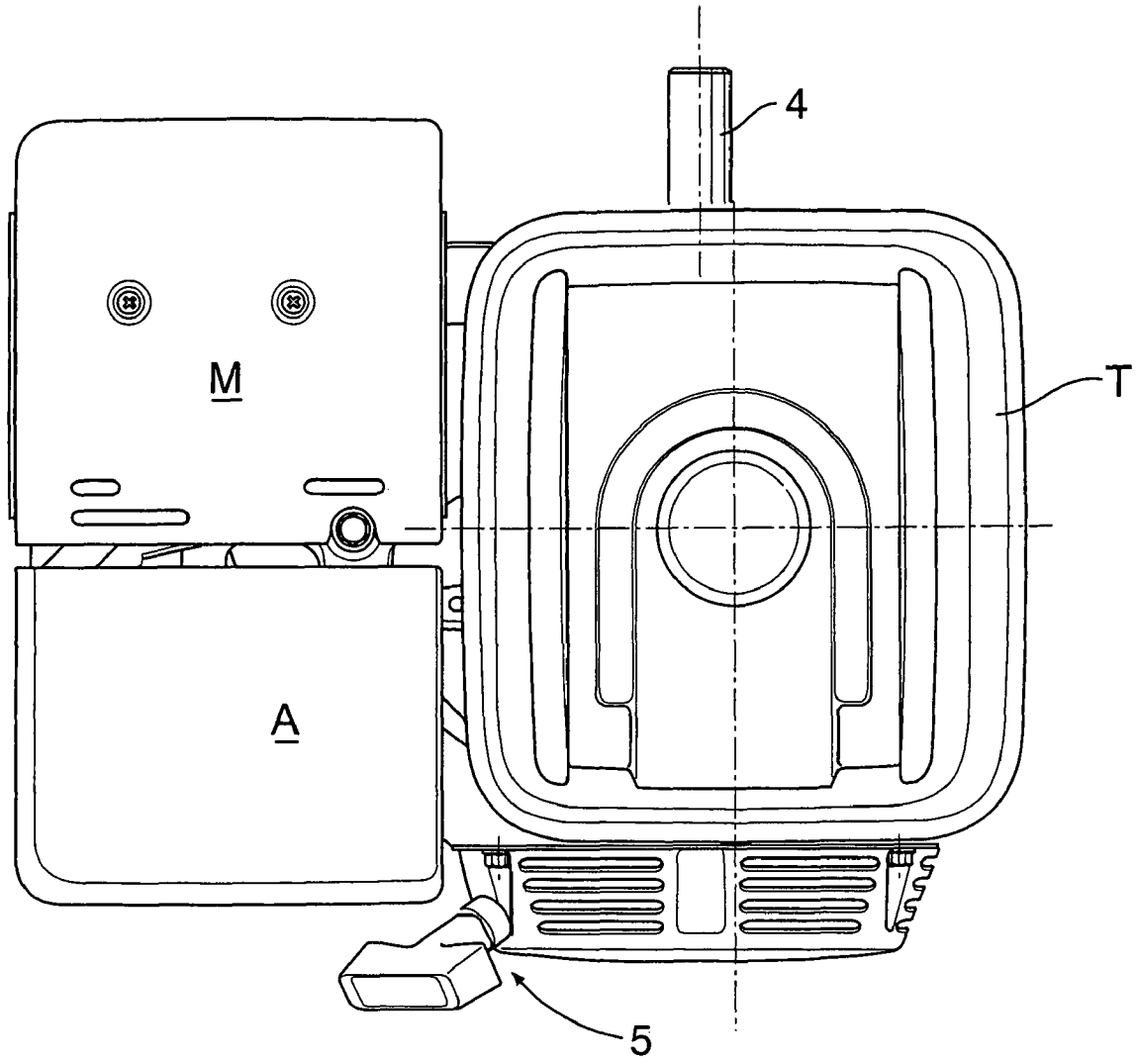
FIG. 3 is a view from arrow 3 in FIG. 1. (first embodiment)

Firstly, as shown in FIG. 1 to FIG. 3, an engine main body 1 of a general purpose engine E includes: a crank case 2 having a mounting flange 2*a* on a lower face thereof and horizontally supporting a crank shaft 4; and a cylinder 3 projecting obliquely upward on one side from the crank case 2. A recoil type engine starter 5 for cranking the crank shaft 4 is mounted on a front side of the crank case 2. Mounted on the engine main body 1 are a fuel tank T disposed above the crank case 2, and an air cleaner A and an exhaust muffler M adjoining the fuel tank T above the cylinder 3. Attached to one side of a head part of the cylinder 3 is a carburetor C for supplying into the cylinder 3 an air-fuel mixture formed by taking in air through the air cleaner A.

Figure 4:
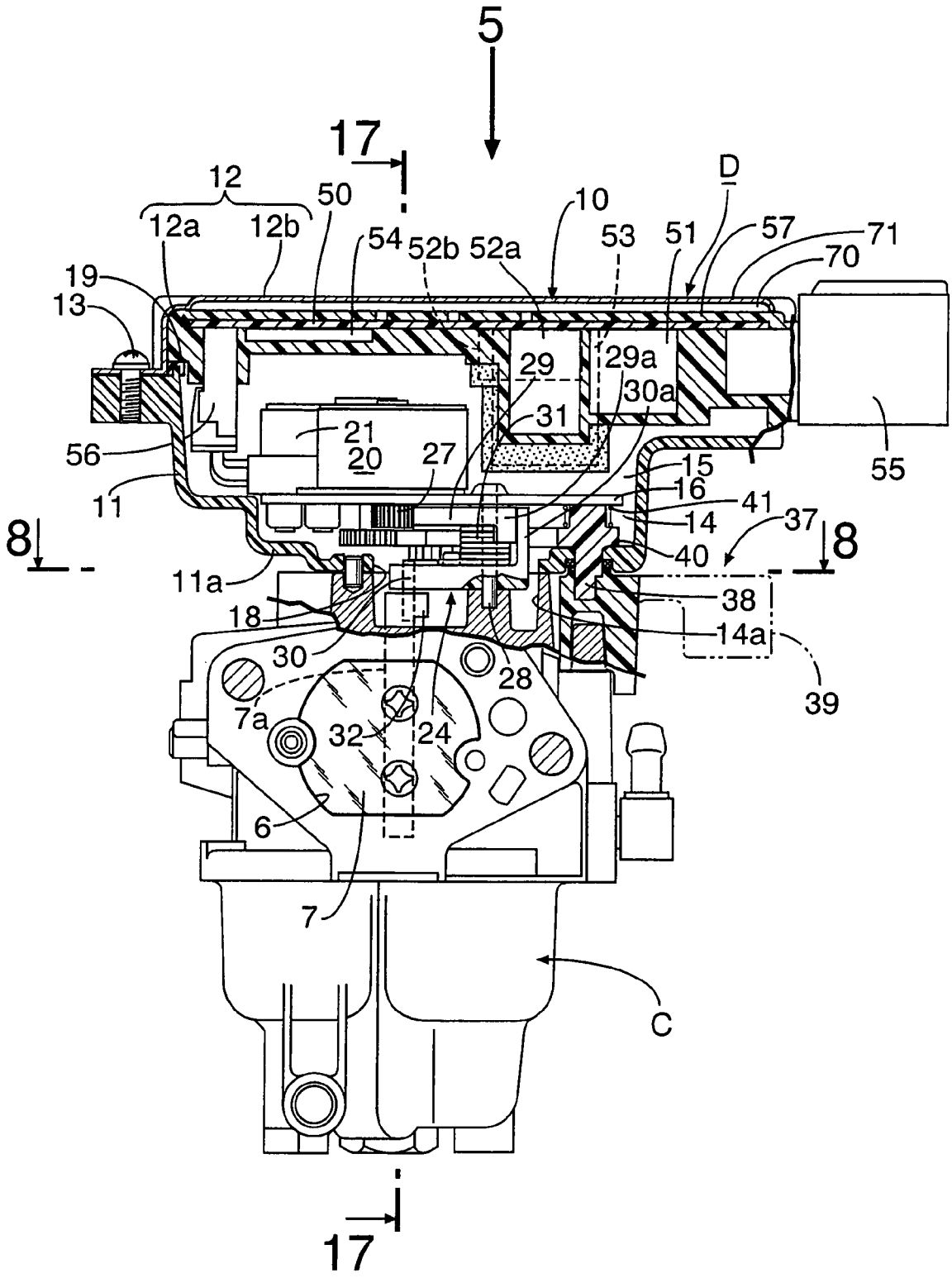
FIG. 4 is a sectional view along line 4-4 in FIG. 2. (first embodiment)
Figure 8:
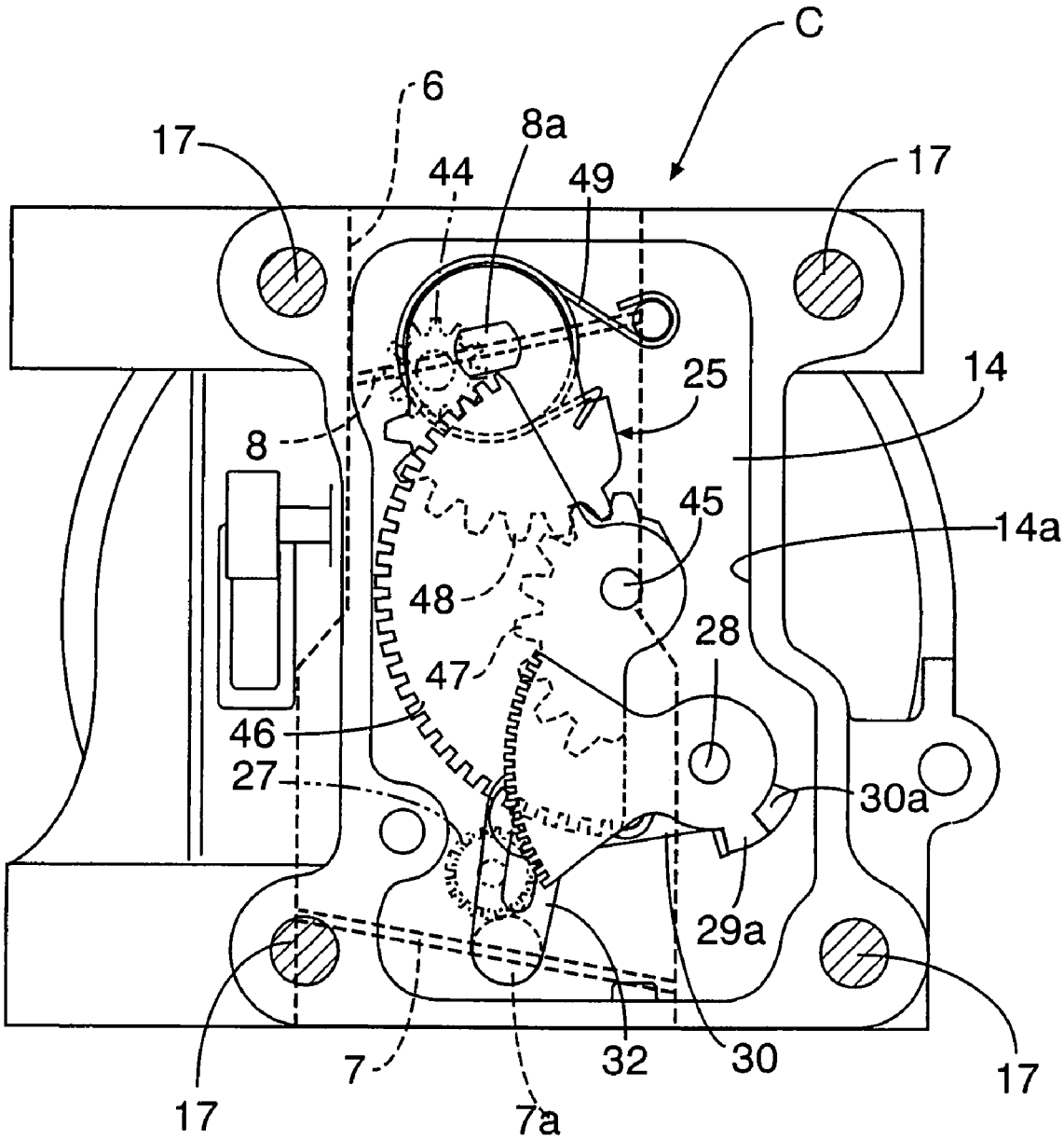
FIG. 8 is a sectional view along line 8-8 in FIG. 4. (first embodiment)

As shown in FIG. 4 and FIG. 8, the carburetor C has an intake path 6 communicating with an intake port of the head part of the cylinder 3. In the intake path 6, sequentially from the upstream side, that is, from the air cleaner A side, a choke valve 7 and a throttle valve 8 are disposed. A fuel nozzle (not illustrated) opens in a venturi part of the intake path 6 in a middle section between the two valves 7 and 8. Both the choke valve 7 and the throttle valve 8 are of a butterfly type, in which they are opened and closed by pivoting of valve shafts 7*a* and 8*a*. An electronic control system D for automatically controlling the degree of opening of the choke valve 7 and the throttle valve 8 is mounted above the carburetor C. Hereinafter, the valve shaft 7*a* of the choke valve 7 is called a choke valve shaft 7*a*, and the valve shaft 8*a* of the throttle valve 8 is called a throttle valve shaft 8*a*.

The electronic control system D is described by reference to FIG. 4 to FIG. 15.

Figure 5:
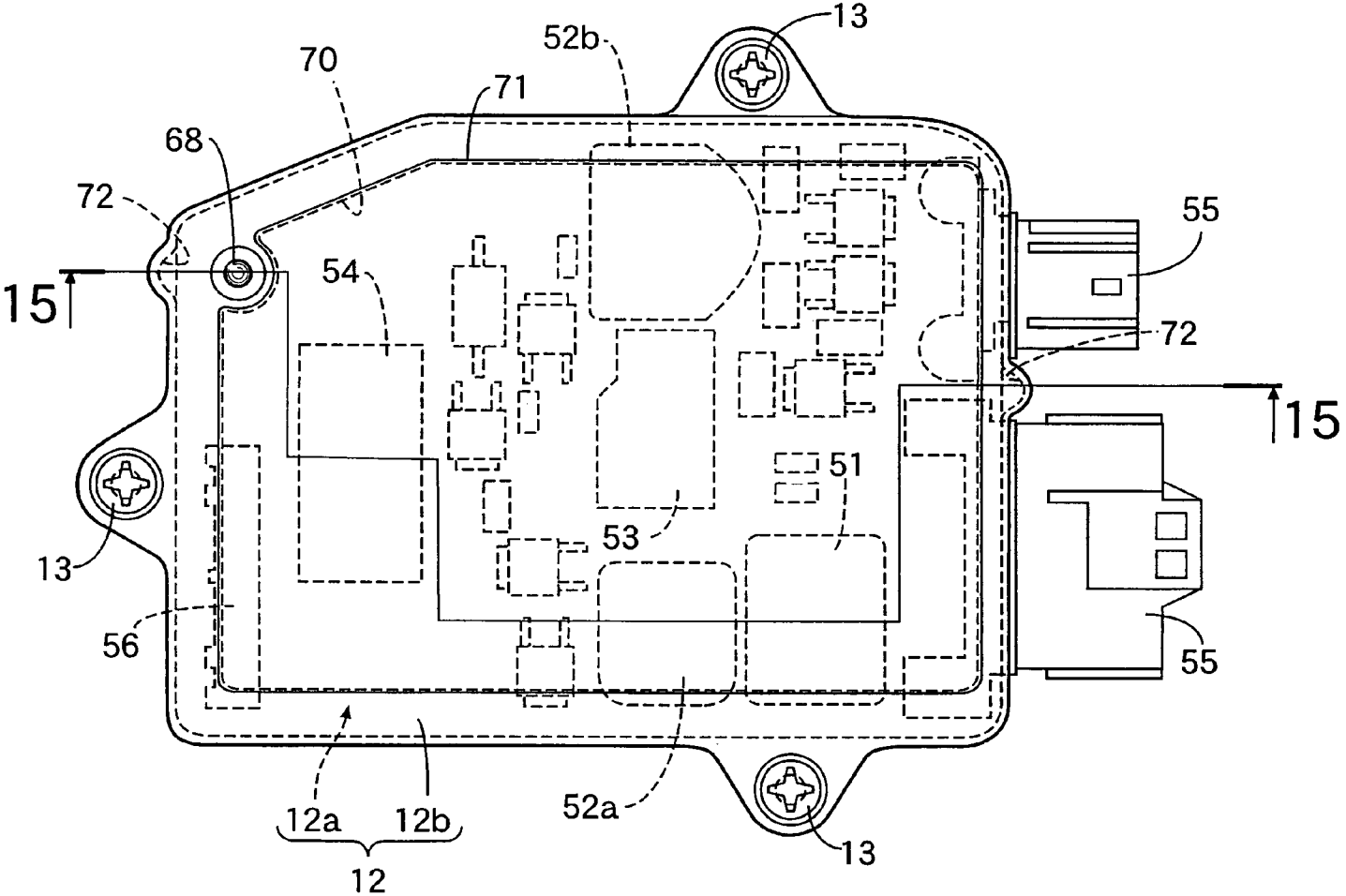
FIG. 5 is a view from arrow 5 in FIG. 4 (plan view of an electronic control system). (first embodiment)

Firstly, in FIG. 4 and FIG. 5, a casing 10 of the electronic control system D: a casing main body 11 having a base wall 11*a* joined to an upper end face of the carburetor C; and a lid 12 joined to the casing main body 11 so as to close an open face thereof. The lid body 12 comprises: a flat box-shaped cover 12*b* made of a steel plate joined to the casing main body 11 by a bolt 13 so as to close its open end face; and an electronic control unit 12*a* fitted into the inside of the cover 12*b*, and held between the cover 12*b* and the casing main body 11. An endless seal 19 is fitted onto an inner peripheral edge of the open end face of the casing main body 11, the seal 19 being in intimate contact with a lower face of an outer peripheral part of the electronic control unit 12*a*.

Figure 15:
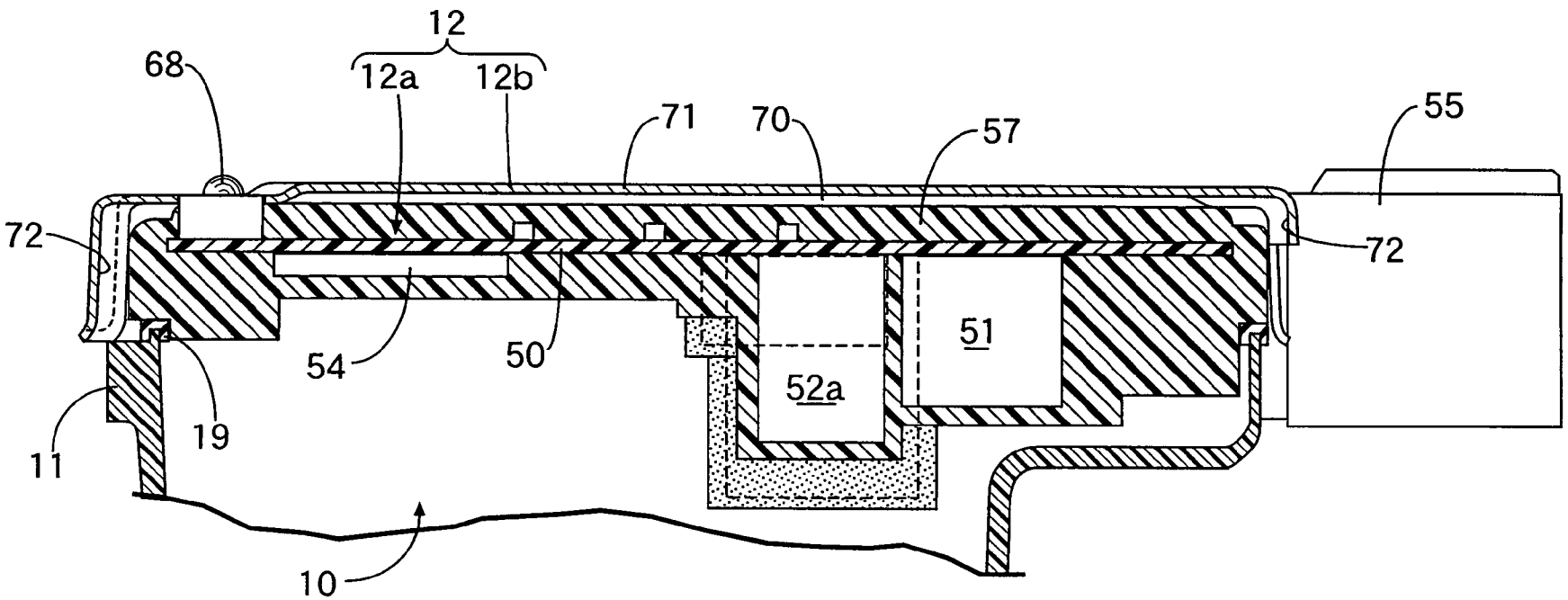
FIG. 15 is a sectional view along line 15-15 in FIG. 5. (first embodiment)

As shown in FIG. 4 and FIG. 15, a bulging part 71 causing its portion other than its peripheral portion to bulge outwardly is formed on the cover 12*b*, to form a gap 70 between itself and the electronic control unit 12*a*. An air passage 72 providing communication between the gap 70 and the open end of the cover 12*b* is provided between the electronic control unit 12*a* and the cover 12*b*. The air passage 72 is bent into a hook shape and has its outer end facing downward so as to be open to the atmosphere.

Figure 6:
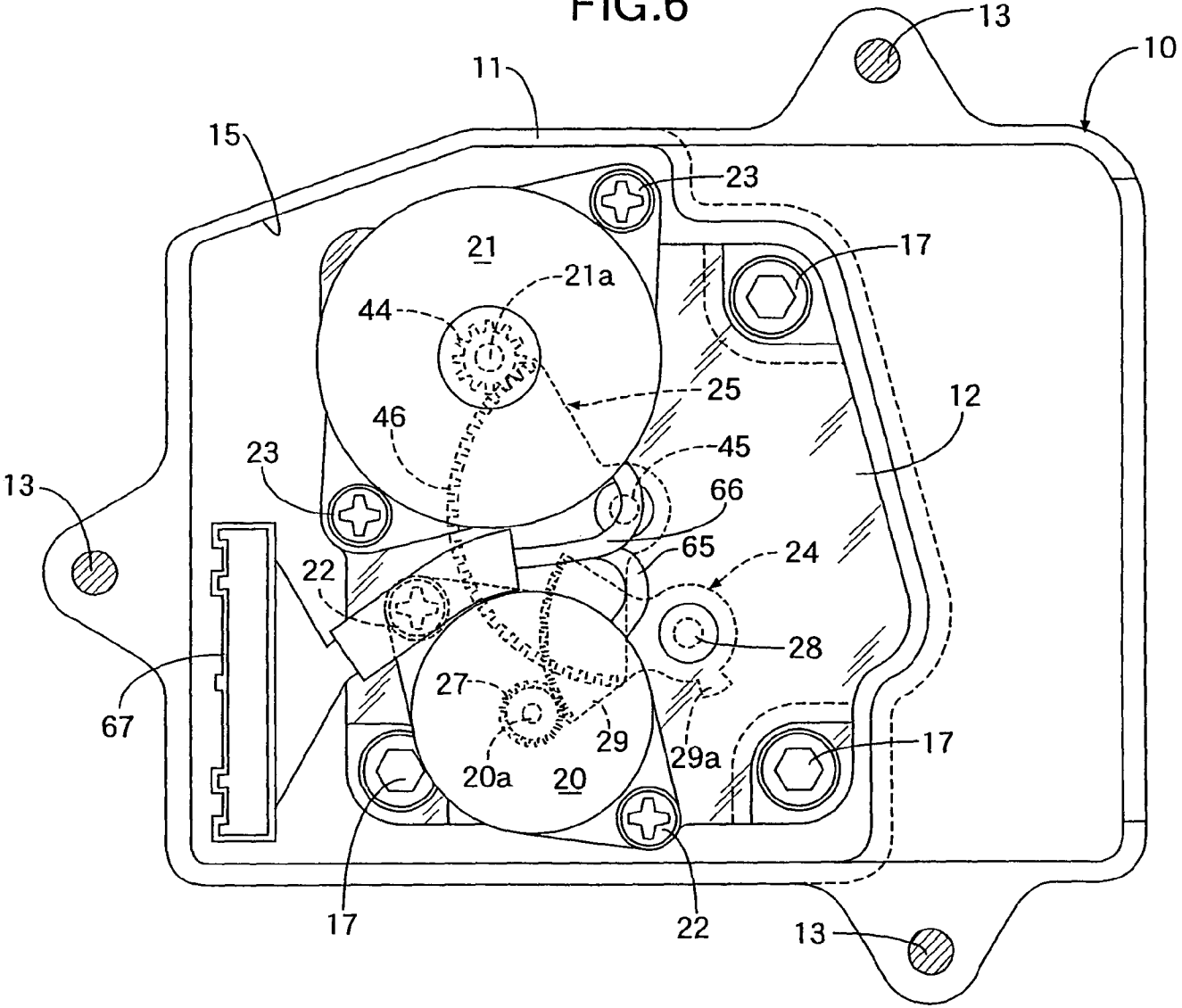
FIG. 6 is a plan view showing a state in which the electronic control system has its lid body removed. (first embodiment)
Figure 7:
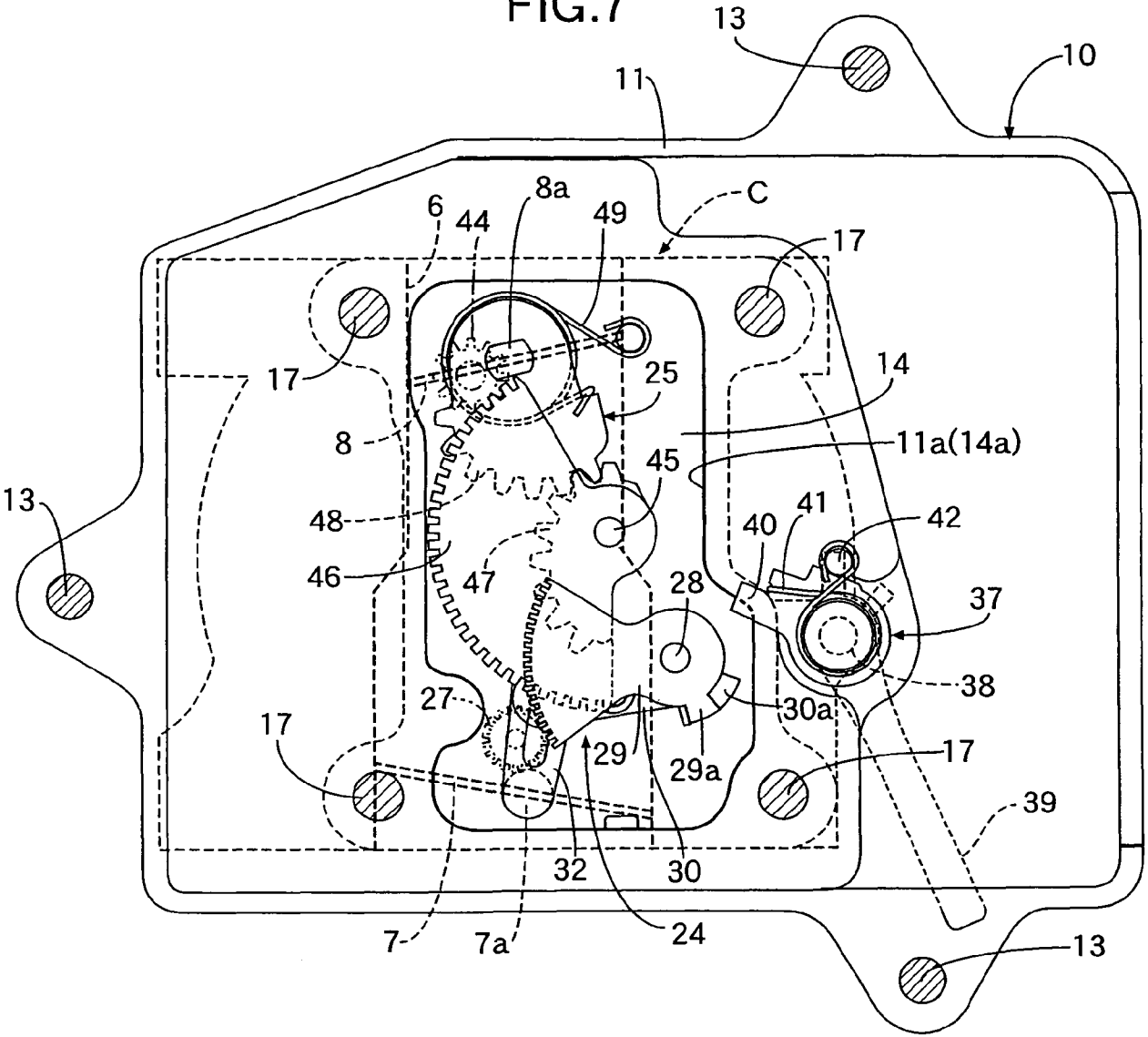
FIG. 7 is a plan view showing a state in which the electronic control system has its lid body and partition plate removed. (first embodiment)

As shown in FIG. 4, FIG. 6, and FIG. 7, a partition plate 16 is provided within the casing main body 11 to divide the interior of the casing 10 into a transmission chamber 14 on the base wall 11*a* side and a drive chamber 15 on the lid 12 side, the partition 16 being a separate body from the casing main body 11. The partition plate 16 is secured to the carburetor C together with the base wall 11*a* by a plurality of bolts 17.

An opening 18 is provided in the base wall 11*a* of the casing main body 11. A depression 14*a* corresponding to the opening 18 is provided on the upper end face of the carburetor C. The depression 14*a* acts as part of the transmission chamber 14. Outer end parts of the choke valve shaft 7*a* and the throttle valve shaft 8*a* are arranged so as to face the depression 14*a*.

A first electric motor 20 and a second electric motor 21 are mounted on the partition plate 16 by screws 22 and 23 respectively in the drive chamber 15. Disposed in the transmission chamber 14 are a first transmission device 24 for transmitting an output torque of the first electric motor 20 to the choke valve shaft 7*a*, and a second transmission device 25 for transmitting a driving force of the second electric motor 21 to the throttle valve shaft 8*a*. In this way, the first and second electric motors 20 and 21 and the first and second transmission devices 24 and 25 are housed in the casing 10 and protected.

Figure 9:
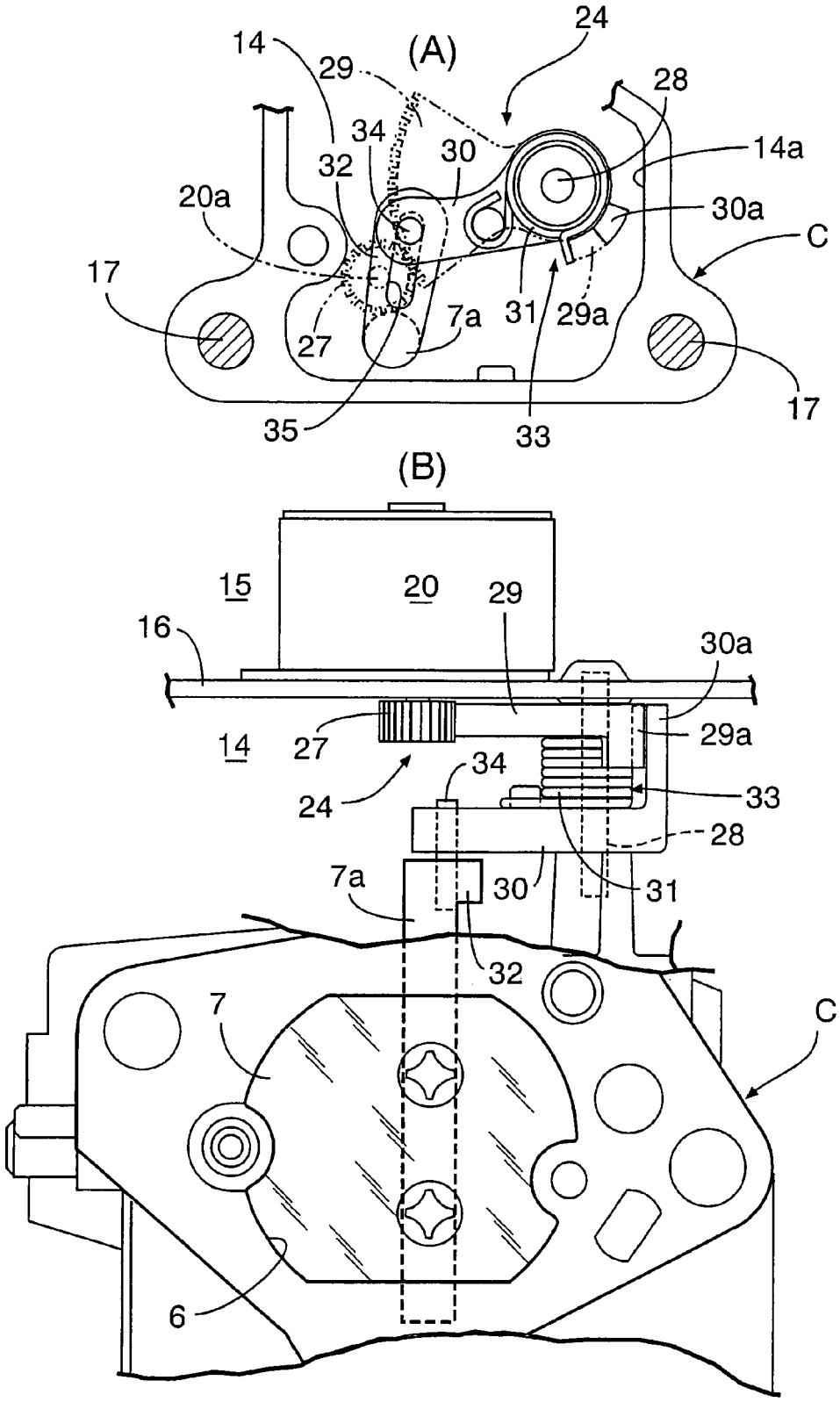
FIG. 9(A) is a plan view and FIG. 9(B) is a front view, of a first transmission system controlling a choke valve into a fully closed state. (first embodiment)

As shown in FIG. 7 to FIG. 9, the first transmission device 24 includes: a first pinion 27 secured to an output shaft 20*a* of the first electric motor 20; a first sector gear 29 that is rotatably supported on a first support shaft 28 having opposite end parts thereof supported on the partition plate 16 and the carburetor C and that meshes with the first pinion 27; a relief lever 30 supported on the first support shaft 28 while being relatively rotatably superimposed on the first sector gear 29; and a choke lever 32 formed integrally with the outer end part of the choke valve shaft 7*a* and joined to the relief lever 30. Formed on the first sector gear 29 and the relief lever 30 respectively are abutment pieces 29*a* and 30*a* that abut against each other and transmit to the relief lever 30 a driving force of the first sector gear 29 in a direction that opens the choke valve 7. A relief spring 31, which is a torsional coil spring, is mounted around the first support shaft 28. With a fixed set load, the relief spring 31 urges the first sector gear 29 and the relief lever 30 in a direction that makes the abutment pieces 29*a* and 30*a* abut against each other.

As clearly shown in FIG. 9, the structure linking the relief lever 30 and the choke lever 32 to each other is established by slidably engaging a connecting pin 34 projectingly provided on a side face at an extremity of the relief lever 30 with an oblong hole 35 that is provided in the choke lever 32 and that extends in the longitudinal direction of the lever 32.

The output torque of the first electric motor 20 is thus reduced and transmitted from the first pinion 27 to the first sector gear 29. Since the first sector gear 29 and the relief lever 30 are usually coupled via the abutment pieces 29*a*, 30*a* and the relief spring 31 to integrally pivot, the output torque of the first electric motor 20 transmitted to the first sector gear 29 can be transmitted from the relief lever 30 to the choke lever 32 and the choke valve shaft 7*a*, thus enabling the choke valve 7 to be opened and closed.

As shown in FIG. 8, the choke valve shaft 7*a* is positioned offset to one side from the center of the intake path 6, and the choke valve 7 is inclined relative to the central axis of the intake path 6 so that, in a fully closed state, a side of the choke valve 7 that has a larger rotational radius is on the downstream side of the intake path 6 relative to a side thereof that has a smaller rotational radius. Therefore, while the first electric motor 20 is operated so that the choke valve 7 is fully closed or held at a very small opening-degree, if the intake negative pressure of the engine E exceeds a predetermined value, the choke valve 7 can be opened regardless of the operation of the first electric motor 20, to a point at which the difference between the rotational moment due to the intake negative pressure imposed on the side of the choke valve 7 that has the larger rotational radius and the rotational moment due to the intake negative pressure imposed on the side of the choke valve 7 that has the smaller rotational radius, balances the rotational moment due to the relief spring 31 (see FIGS. 11A and 11B). The relief lever 30 and the relief spring 31 thus form a relief mechanism 33. The relief lever 30 and relief spring 31 are supported on the first support shaft 28, and are therefore positioned so as to be offset from the top of the output shaft 20*a* of the first electric motor 20 and the top of the choke valve shaft 7*a*.

Figure 10:
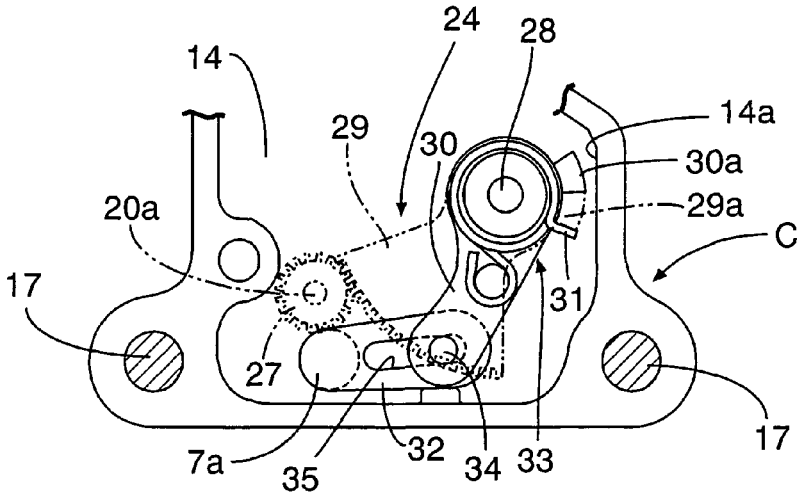
FIG. 10(A) is a plan view and FIG. 10(B) is a front view, of the first transmission system controlling the choke valve into a fully open state. (first embodiment)
Figure 10:
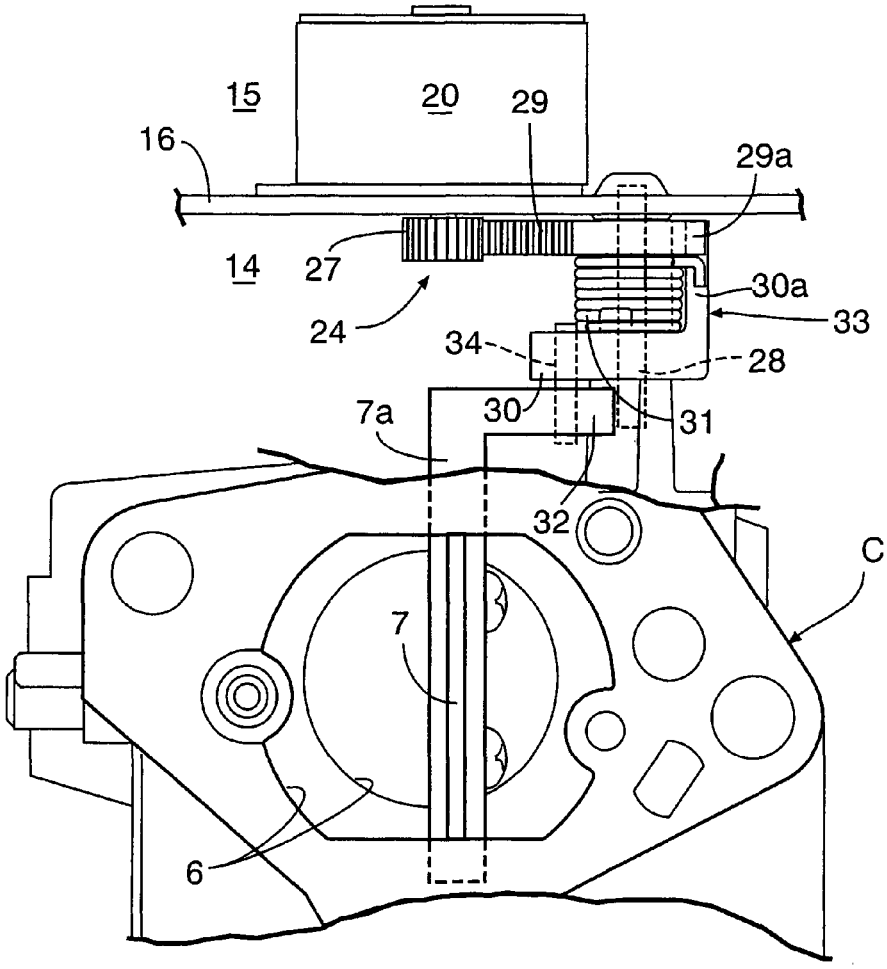
Figure 11:
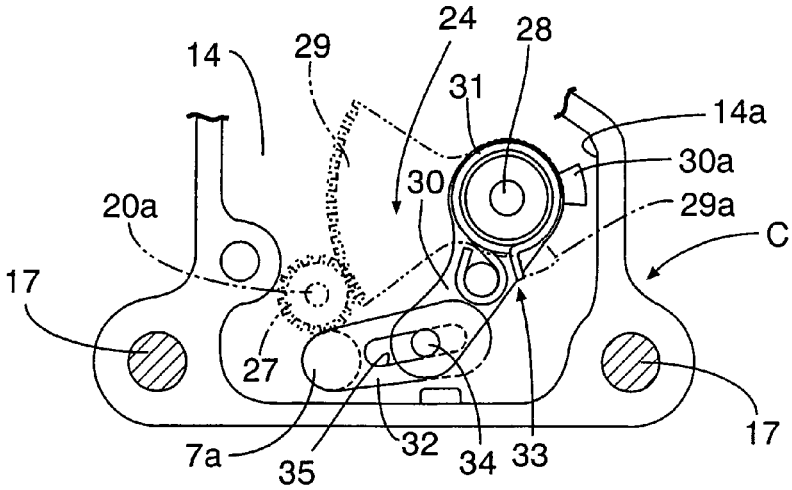
FIG. 11(A) is a plan view and FIG. 11(B) is a front view, of the first transmission system showing an actuated state of a relief mechanism. (first embodiment)
Figure 11:
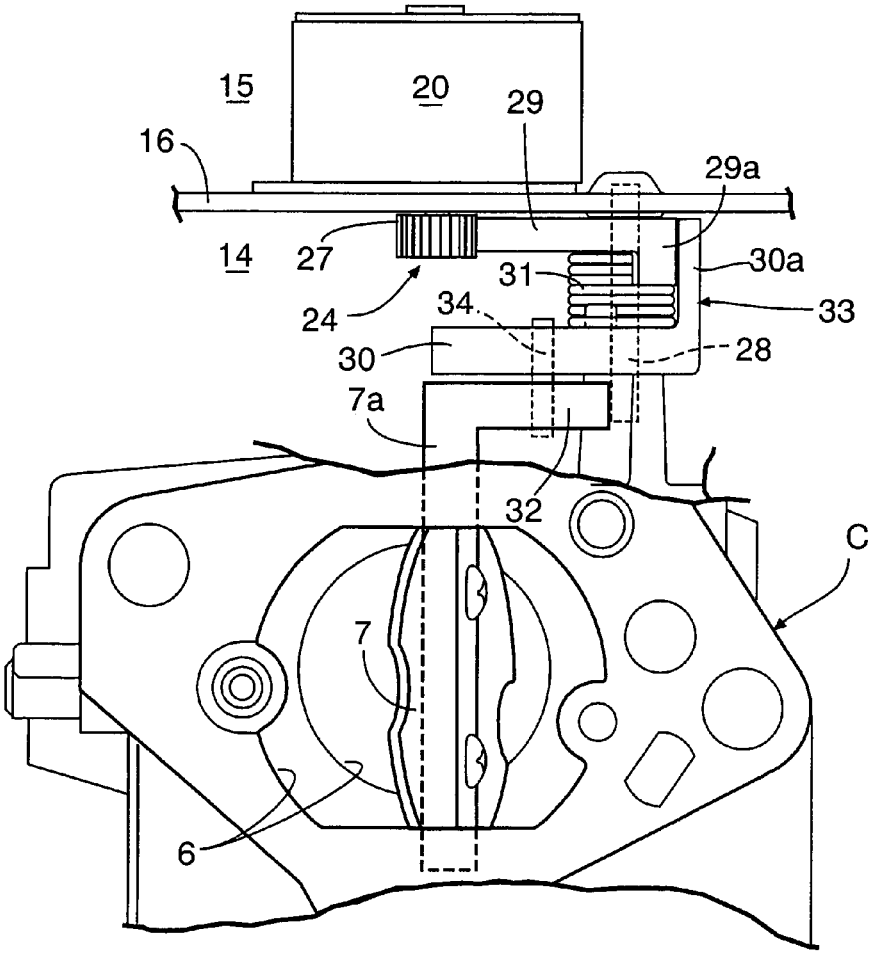
Figure 12:
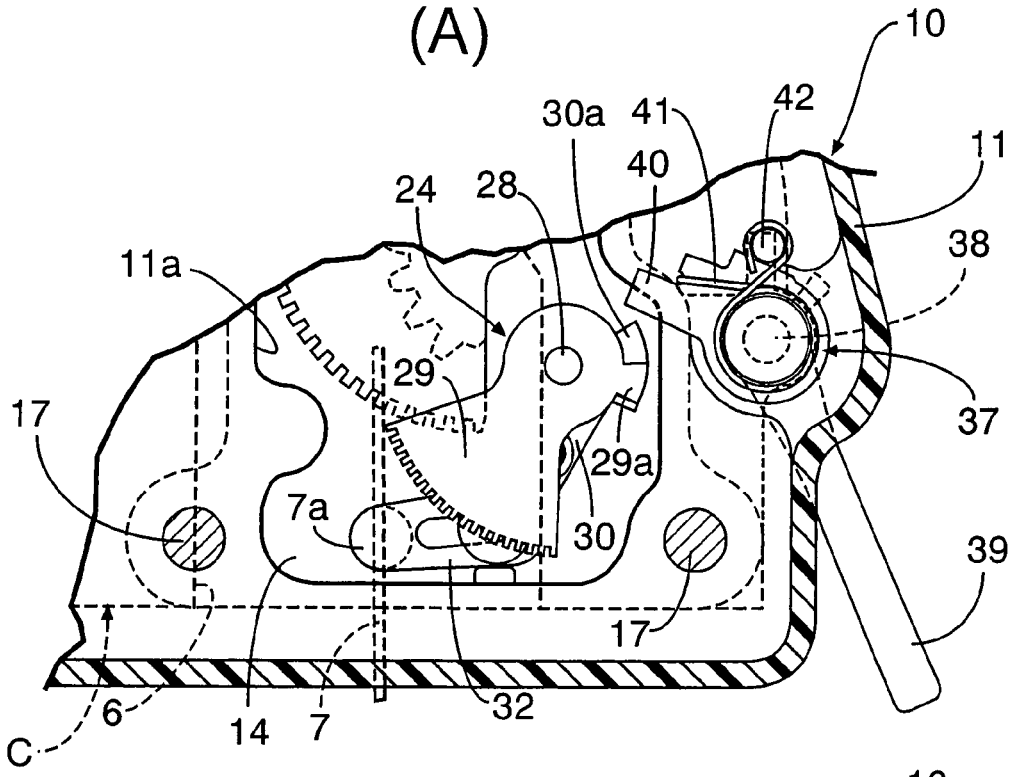
FIG. 12(A) is a plan view showing a non-actuated state and FIG. 12(B) is a plan view showing an actuated state, of a choke valve forced closure mechanism in FIG. 7. (first embodiment)
Figure 12:
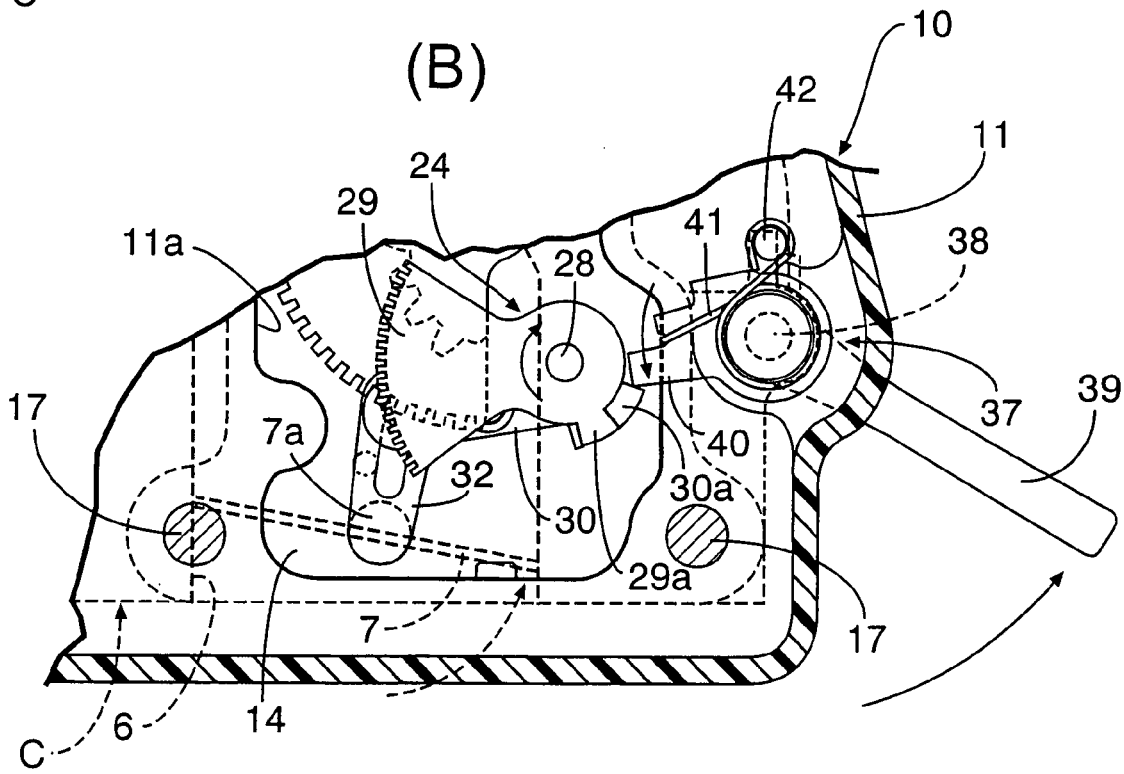
Figure 14:
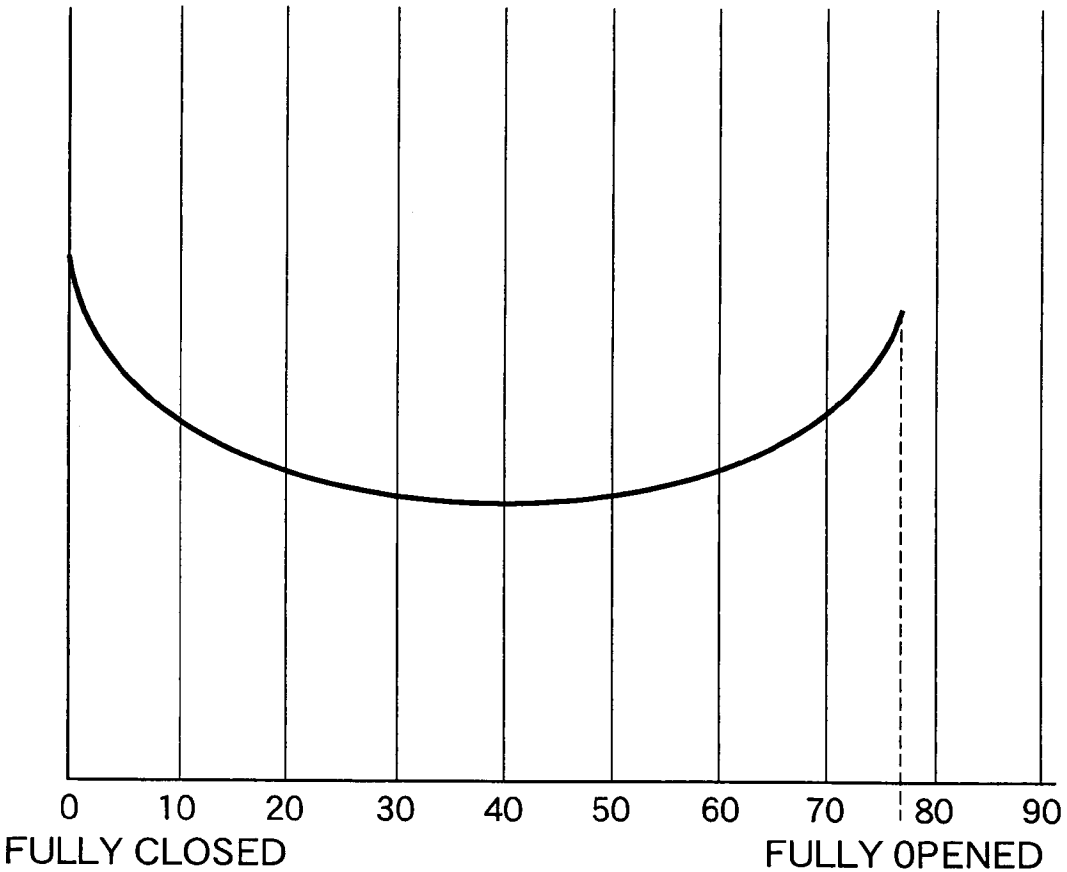
FIG. 14 is a graph showing the relationship between the opening degree of the choke valve, and the lever ratio between a relief lever and a choke lever. (first embodiment)

As shown in FIGS. 9 and 10, the relief lever 30 and the choke lever 32 are arranged at an exactly or approximately right angle when the choke valve 7 is in a fully opened position and in a fully closed position, and the connecting pin 34 is positioned at the end of the oblong hole 35 that is farther from the choke valve shaft 7*a*. When the choke valve 7 is at a predetermined medium opening-degree, the relief lever 30 and the choke lever 32 are arranged in a straight line, and the connecting pin 34 is positioned at the other end of the long hole 35 that is closer to the choke valve shaft 7*a*. Therefore, the effective arm length of the choke lever 32 becomes a maximum when the choke valve 7 is in fully opened and fully closed positions, and becomes a minimum when the choke valve 7 is at the predetermined medium opening-degree. As a result, the lever ratio between the relief lever 30 and the choke lever 32 changes, as shown in FIG. 14, such that it becomes a maximum when the choke valve 7 is in fully opened and fully closed positions and becomes a minimum when the choke valve 7 is at the predetermined medium opening-degree.

Even if the first electric motor 20 becomes inoperable when the choke valve 7 is in the fully opened state due to, for example, an insufficient amount of electricity stored in a battery 60 (FIG. 13) which will be described later, the engine E can be started because a choke valve forced closure mechanism 37 that forcibly closes the choke valve 7 is provided to adjoin one side of the relief lever 30.

As shown in FIG. 4, FIG. 7, and FIGS. 12A and 12B, the choke valve forced closure mechanism 37 includes: a lever shaft 38 having opposite end parts rotatably supported on the base wall 11*a* of the casing main body 11 and the carburetor C; an operating lever 39 coupled to the lever shaft 38 and disposed beneath the casing main body 11; an actuating arm 40 formed integrally with the lever shaft 38 and facing one side of the abutment piece 30*a* of the relief lever 30; and a return spring 41 which is a torsional coil spring and is connected to the actuating arm 40 so as to urge the actuating arm 40 in a direction that detaches it from the abutment piece 30*a*, that is, in a retraction direction. When the choke valve 7 is fully opened, by making the operating lever 39 pivot against the urging force of the return spring 41, the actuating arm 40 pushes the abutment piece 30*a* of the relief lever 30 in a direction that closes the choke valve 7.

The retraction position of the operating lever 39 and the actuating arm 40, which are connected integrally to each other, is restricted by one side of the actuating arm 40 abutting against a retaining pin 42 provided in the casing main body 11 so as to retain the fixed end of the return spring 41. The operating lever 39 is usually positioned so that it is not accidentally hit by any other objects, for example, in such a manner that the extremity of the operating lever 39 faces the engine E side. With this arrangement, erroneous operation of the operating lever 39 can be avoided.

The second transmission device 25 is now described by reference to FIG. 4, FIG. 6, and FIG. 7.

The second transmission device 25 includes: a second pinion 44 secured to the output shaft 21*a* of the second electric motor 21; a second sector gear 46 that is rotatably supported on a second support shaft 45 having opposite end parts supported on the partition plate 16 and the carburetor C and that meshes with the second pinion 44; a non-constant speed drive gear 47 integrally molded with one side of the second sector gear 46 in the axial direction; and a non-constant speed driven gear 48 secured to an outer end part of the throttle valve shaft 8*a* and meshing with the non-constant speed drive gear 47. Connected to the non-constant speed driven gear 48 is a throttle valve closing spring 49 that urges the non-constant speed driven gear 48 in a direction that closes the throttle valve 8. By employing part of an elliptic gear or an eccentric gear, both the non-constant-speed drive and driven gears 47 and 48 are designed so that the gear ratio, that is, the reduction ratio between them decreases in response to an increase in the degree of opening of the throttle valve 8. Therefore, the reduction ratio is a maximum when the throttle valve 8 is in a fully closed state. With this arrangement, it becomes possible to minutely control the degree of opening in a low opening-degree region, which includes an idle opening-degree of the throttle valve 8, by operation of the second electric motor 21.

The first and second support shafts 28 and 45, which are components of the first and second transmission devices 24 and 25, are supported by opposite end parts thereof being fitted into the carburetor C and the partition plate 16, and serves as positioning pins for positioning the partition plate 16 at a fixed position relative to the carburetor C. Therefore, it is unnecessary to employ a positioning pin used exclusively for this purpose, thereby contributing to a reduction in the number of components. With this positioning of the partition plate 16, it is possible to appropriately couple the first transmission device 24 to the choke valve shaft 7*a*, and couple the second transmission device 25 to the throttle valve 8. Moreover, since the first and second electric motors 20 and 21 are mounted on the partition plate 16, it is possible to appropriately couple the first electric motor 20 to the first transmission device 24, and couple the second electric motor 21 to the second transmission device 25.

Figure 17:
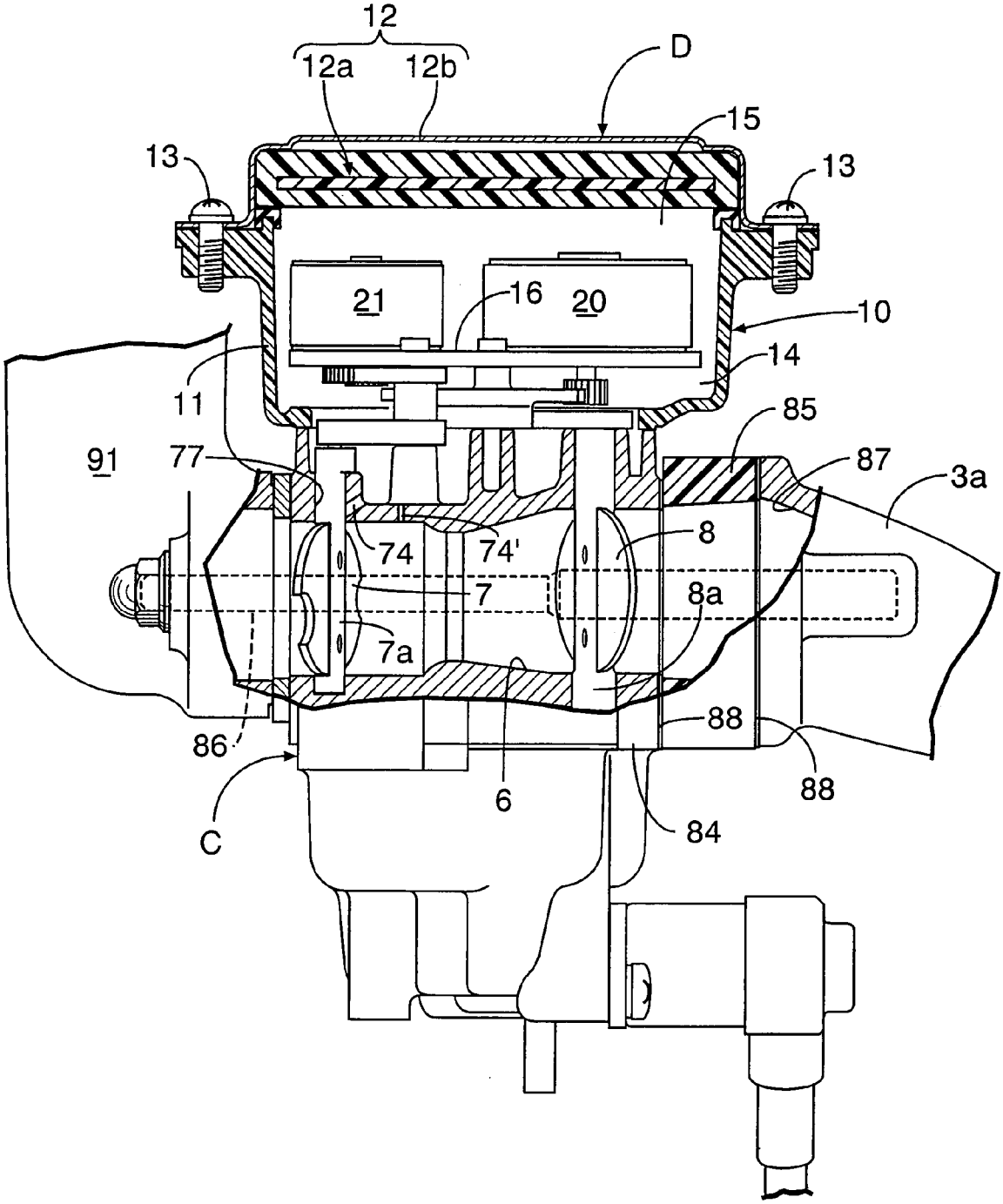
FIG. 17 is a sectional view along line 17-17 in FIG. 4. (first embodiment)

As shown in FIG. 17, provided in the carburetor C is an air passage structure of the interior of the casing 10, that is, the transmission chamber 14 and the drive chamber 15 which communicate with each other. This air passage structure comprises a vent 74 or 74' that is bored in an upper side wall of the carburetor C and that provides communication between a base part of the interior of the casing 10 and the intake path 6. The vent 74 is provided so as to open in the intake path 6 via a bearing hole 77 rotatably supporting the choke valve shaft 7*a*. The vent 74' is provided so as to open directly in the intake path 6.

The electronic control unit 12*a* is now described by reference to FIG. 4, FIG. 5, and FIG. 13.

As shown in FIG. 4 and FIG. 5, the electronic control unit 12*a* is formed by mounting various types of electronic components 51 to 54 on a substantially rectangular board 50 having an electric circuit formed thereon by print-wiring, and connecting an input connector 55 and an output connector 56 to longitudinally opposite ends of the board 50. The board 50 is positioned parallel to the base wall 11*a* of the casing main body 11. Mounted on an inside face of the board 50 facing the drive chamber 15 are, for example, tall large electronic components such as a transformer 51, capacitors 52*a* and 52*b*, and a heatsink 53, as well as thin low-profile electronic components such as a CPU 54. A pilot lamp 68 is mounted on an outside face of the board 50. The large electronic components 51 to 53 and the low-profile electronic component 54 are thus contained within the drive chamber 15, the large electronic components 51 to 53 being positioned in the vicinity of the partition plate 16 on one side of the drive chamber 15, and the low-profile electronic component 54 being positioned on the other side of the drive chamber 15. The first and second electric motors 20 and 21 are positioned in the vicinity of the board 50 and the low-profile electronic component 54 on said other side of the drive chamber 15. In this way, the first and second electric motors 20, 21 and the large electronic components 51 to 53 are arranged in a staggered manner.

With this staggered arrangement, the first and second electric motors 20, 21 and the large electronic components 51 to 53 can be efficiently housed in the drive chamber 15. Therefore, the dead space in the drive chamber 15 can be greatly reduced and the volume of the drive chamber 15 can be made smaller, thereby reducing the size of the casing 10 and consequently making compact the entire engine E including the carburetor C equipped with the electronic control system D.

In order to seal the board 50 mounting thereon the various types of electronic components 51 to 54, a synthetic resin coating 57 for covering these components is formed. This coating 57 is formed to have a substantially uniform thickness along the shapes of the board 50 and the various types of electronic components 51 to 54.

A light-emitting part of the pilot lamp 68 (FIG. 5) is positioned so as to run through the coating 57 and the cover 12*b*, and its lit and unlit states accompanying a main switch 64 being turned on or off can be visually identified from outside the lid 12.

Figure 13:
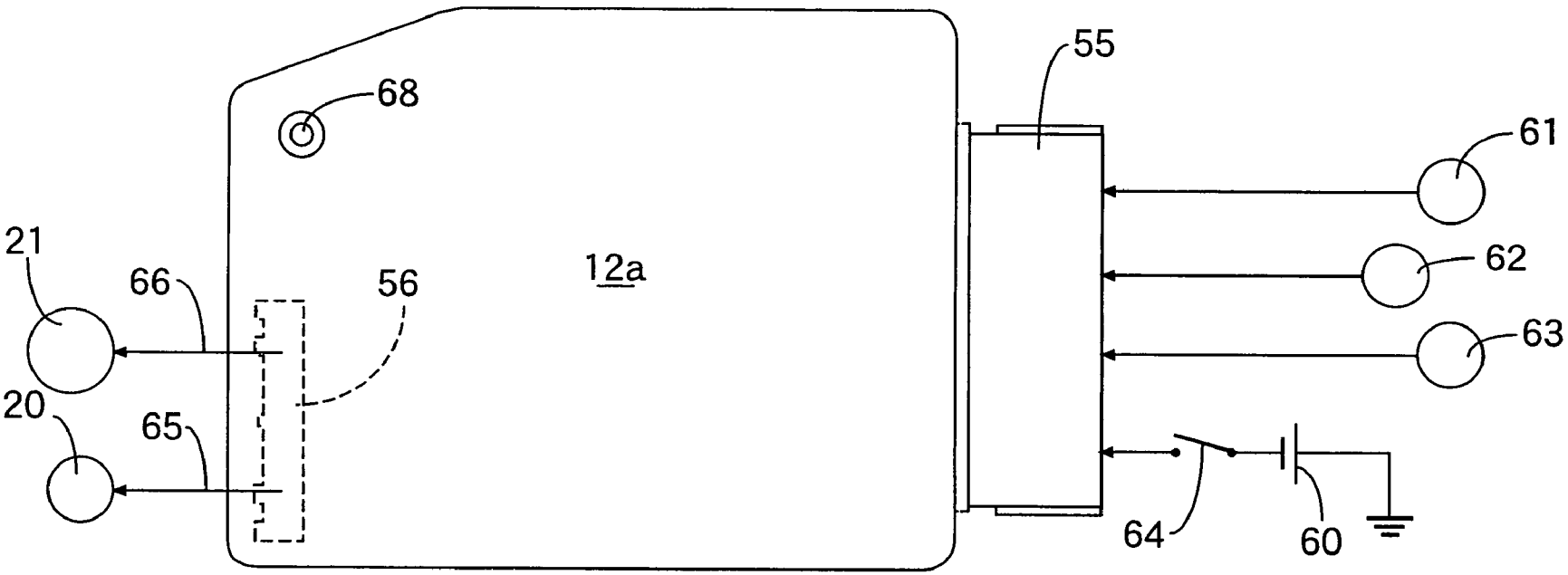
FIG. 13 is a plan view of an electronic control unit. (first embodiment)

In FIG. 13, electric power of the battery 60, an output signal of a rotational speed setting device 61 that sets a desired rotational speed for the engine E, an output signal of a rotational speed sensor 62 for detecting the rotational speed of the engine E, an output signal of a temperature sensor 63 for detecting a temperature of the engine E, etc., are input via the input connector 55 into the electronic control unit 12*a*. The main switch 64 is provided on an energizing circuit between the battery 60 and the input connector 55.

Connected to the output connector 56 is an internal connector 67 (see FIG. 6), which is connected to wire harnesses 65 and 66 for energization of the first and second electric motors 20 and 21.

The operation of this embodiment is now described.

In the electronic control unit 12*a*, when the main switch 64 is switched on, the first electric motor 20 is operated by the power of the battery 60 based on the output signal of the temperature sensor 63, and the choke valve 7 is operated via the first transmission device 24 to a start opening-degree according to the engine temperature at that time. For example, when the engine E is cold, the choke valve 7 is driven to a fully closed position as shown in FIG. 9; and when the engine E is hot, the choke valve 7 is maintained at a fully opened position as shown in FIG. 10. Since the start opening-degree of the choke valve 7 is controlled in this way, by subsequently operating the recoil starter 5 for cranking in order to start the engine E, an air-fuel mixture having a concentration suitable for starting the engine at that time is formed in the intake path 6 of the carburetor C, thus always starting the engine E easily.

Immediately after starting the engine in a cold state, an excessive intake negative pressure of the engine E acts on the choke valve 7 which is in a fully closed state. As a result, as described above, since the choke valve 7 is automatically opened (see FIGS. 11A and 11B), regardless of operation of the first electric motor 20, until the difference between the rotational moment due to the intake negative pressure acting on the side of the choke valve 7 having a large rotational radius and the rotational moment due to the intake negative pressure acting on the side of the choke valve 7 having a small rotational radius balances the rotational moment due to the relief spring 31, the excessive intake negative pressure can be eliminated, thus preventing the air-fuel mixture from becoming too rich to ensure good warming-up conditions for the engine E.

Since the relief mechanism 33, which includes the relief lever 30 and the relief spring 31, is positioned so as to be offset from the top of the output shaft 20*a* of the first electric motor 20 and the top of the choke valve shaft 7*a*, the relief mechanism 33 is not superimposed on the output shaft 20*a* of the first electric motor 20 or the choke valve shaft 7*a*, and the transmission chamber 14 housing the first transmission device 24 can be made flat while providing the relief mechanism 33 in the first transmission device 24, thereby contributing to a reduction in the size of the casing 10.

When the engine temperature increases accompanying the progress of warming-up, the first electric motor 20 is operated based on the output signal of the temperature sensor 63 which changes according to the engine temperature, so that the choke valve 7 is gradually opened via the first transmission device 24. When the warming-up is completed, the choke valve 7 is put in a fully opened state (see FIG. 10), and this state is maintained during subsequent running.

On the other hand, the second electric motor 21 operates based on the output signals of the rotational speed setting device 61 and the rotational speed sensor 62, and controls opening and closing of the throttle valve 8 via the second transmission device 25 so that the engine rotational speed coincides with a desired rotational speed set by the rotational speed setting device 61, thus regulating the amount of air-fuel mixture supplied from the carburetor C to the engine E. That is, when an engine rotational speed detected by the rotational speed sensor 62 is lower than the desired rotational speed set by the rotational speed setting device 61, the degree of opening of the throttle valve 8 is increased, and when it is higher than the desired rotational speed, the degree of opening of the throttle valve 8 is decreased, thus automatically controlling the engine rotational speed to be the desired rotational speed regardless of a change in the load. It is therefore possible to drive various types of work machines by the motive power of the engine E at a stable speed regardless of a change in the load.

Running of the engine E can be stopped by switching the main switch 64 off and operating a kill switch (not illustrated) of the engine E. After completing a given operation, the engine E is usually in a hot state, and thus the choke valve 7 is maintained in a fully opened state by the first electric motor 20. Therefore, after running of the engine E is stopped, the fully opened state of the choke valve 7 is maintained. When the engine E is left in a cold region, an icing phenomenon often occurs, that is, water droplets condensed around the choke valve shaft 7*a* are frozen and the choke valve 7 becomes stuck. Such a phenomenon generally makes it difficult for the choke valve 7 to move to the fully closed state when the engine is started anew.

However, in the first transmission device 24, as described above, the structure coupling the relief lever 30 and the choke lever 32 to each other is arranged so that the lever ratio of the two levers 30 and 32 is a maximum when the choke valve 7 is in fully opened and fully closed positions, and a minimum when the choke valve 7 is at the predetermined medium opening-degree. Therefore, when the engine E is cold-started and the first electric motor 20 operates in a direction that closes the choke valve 7 based on the output signal of the temperature sensor 63, a maximum torque can be applied to the choke valve shaft 7*a*, thus crushing ice around the choke valve shaft 7*a* to reliably drive the choke valve 7 from the fully opened position to the fully closed position, whereby the reliability of an autochoke function is guaranteed without any problem in the cold starting.

Moreover, with the structure coupling the relief lever 30 and the choke lever 32 to each other, the torque acting on the choke valve shaft 7*a* from the first electric motor 20 can be made a maximum at least when the choke valve 7 is in the fully opened position. Therefore, an increase in the number of stages of reduction gears such as the first pinion 27 and the first sector gear 29 of the first transmission device 24 can be suppressed, thereby contributing to a reduction in the size of the first transmission device 24, and consequently reducing the volume of the transmission chamber 14 and the size of the casing 10. Furthermore, an unreasonable reduction ratio need not be given to the first pinion 27 and the first sector gear 29, and there are no concerns about degradation in the tooth base strength of the gears due to an excessive reduction in the module thereof.

During cold starting, if the amount of electricity stored in the battery 60 is insufficient, the first electric motor 20 does not operate, the choke valve 7 remains open as shown in FIG. 12(A), and when starting, a rich air-fuel mixture suitable for cold starting cannot be generated in the intake path 6. In such a case, as shown in FIG. 12(B), the operating lever 39 of the choke valve forced closure mechanism 37 is held and pivoted against the urging force of the return spring 41. As a result, the actuating arm 40, which is coupled to the operating lever 39 and faces the abutment piece 30*a* of the relief lever 30, pushes the abutment piece 30*a*, and this pushing force is transmitted from the relief lever 30 to the choke lever 32 so as to close the choke valve 7 to the fully closed position; if the engine E is started in this operating state, a rich air-fuel mixture suitable for cold starting can be generated in the intake path 6, thus reliably carrying out cold starting.

When the engine E starts, since the function of the battery 60 is recovered due to the operation of a generator generally provided in the engine E, or the generator directly supplies electricity to the electronic control unit 12*a*, the first electric motor 20 operates normally, the choke valve 7 is controlled to an appropriate warm-up opening-degree, and it is therefore necessary to return the actuating arm 40 to a non-operating position retracted from the relief lever 30 so as not to interfere with the operation of the first electric motor 20.

Then, if the hand is released from the operating lever 39, the operating lever 39 and the actuating arm 40 is automatically returned to the non-operating position by virtue of the urging force of the return spring 41, thereby preventing any increase in the load on the first electric motor 20 caused by the operating lever 39 being erroneously left unreturned.

The actuating arm 40 can push the abutment piece 30*a* of the relief lever 30 only in a direction that closes the choke valve 7, and when it is held at the retracted position by a set load of the return spring 41, it merely faces the abutment piece 30*a* of the relief lever 30 and is put in a state in which it is detached from the first transmission device 24. Therefore, when the choke valve 7 is driven normally by the first electric motor 20, the choke valve forced closure mechanism 37 does not impose any load on the first transmission device 24, thereby preventing malfunction of or damage to the first transmission device 24.

In such an electronic control system D, the gap 70 opening to the atmosphere via the air passage 72 is provided between the electronic control unit 12*a* and the cover 12*b* which form the lid body 12 of the casing 10. Therefore, when air between the electronic control unit 12*a* and the cover 12*b* expands or contracts due to heat generation or heat dissipation from the electronic control unit 12*a*, or heating or cooling of the cover 12*b* caused by a change in temperature of the engine E, the gap 70 breathes to prevent an excessive pressure from acting on the electronic control unit 12*a*, and also prevent dew condensation on the electronic control unit 12*a*. As a result, the durability of the electronic control unit 12*a* can be enhanced.

The air passage 72 for ensuring the breathing by the gap 70 extends from the gap 70 in a hook shape, and has its outer end facing downward so as to open to the atmosphere. Therefore, it is difficult for rainwater or the like to enter the gap 70 via the air passage 72. Even if rainwater or the like enters the gap 70, it can easily be discharged from the air passage 72.

Further, since the gap 70 is defined between the cover 12*b* and the electronic control unit 12*a* by forming the bulging part 71 which causes its portion other than its peripheral portion to bulge outwardly on the cover 12*b*, the gap 70 having a uniform thickness can easily be obtained while stabilizing support of the electronic control unit 12*a* by the cover 12*b*. Therefore, the increase in dimensions of the system due to the gap 70 is negligible.

Furthermore, the vent 74 or 74' for providing communication between the base part of the casing main body 11 and the intake path 6 is provided in the upper side wall of the carburetor C. Therefore, the interior of the casing 10 can breathe through the vent 74 or 74', when the air within the casing 10 expands or contracts due to heat generation or heat dissipation from the first and second electric motors 20 and 21 of the electronic control unit 12*a*, or heating or cooling of the casing 10 caused by a change in temperature of the engine E, thereby preventing an excessive pressure from acting on the electronic control unit 12*a* and the first and second electric motors 20 and 21. Moreover, the breathing can also prevent dew condensation on the electronic control unit 12*a* and the first and second electric motors 20 and 21, resulting in improvement of the durability of the electronic control unit 12*a* and the first and second electric motors 20 and 21. Since the intake negative pressure generated in the intake path 6 is transmitted to the interior of the casing 10 via the vent 74 or 74' when the engine E is running, even if water droplets generated due to dew condensation accumulate in the base part of the casing 10, they can be drawn out to the intake path 6.

As described above, since there is no fear of sucking in outside dust when the interior of the casing 10 breathes, the vent 74 or 74' is advantageously open to the intake path 6 rather than to the outside air. Further, with the use of a structure such that the vent 74 opens to the intake path 6 via the bearing hole 77 of the choke valve shaft 7*a*, even if the vent 74 has a large diameter, its open end is constricted between the inner periphery of the bearing hole 77 and the outer periphery of the choke valve shaft 7*a* fitted into the bearing hole 77. Therefore, it is possible to easily prevent fuel contained in some amount in blow-back gas from entering the vent 74 when the engine E blows back, and it is thus relatively easy to bore the large diameter vent 74.

Further, the large electronic components 51 to 53 of the electronic control unit 12*a* are disposed in the proximity of the partition plate 16 on one side part of the drive chamber 15, the low-profile electronic component 54 is disposed on the other side part of the drive chamber 15, and the first and second electric motors 20 and 21 are disposed on said other side part of the drive chamber 15 so as to be in the proximity of the board 50 and the low-profile electronic component 54. Therefore, the first and second electric motors 20 and 21 are disposed in a staggered manner relative to the large electronic components 51 to 53, thereby efficiently housing the first and second electric motors 20 and 21 and the large electronic components 51 to 53 in the drive chamber 15. Thus, it is possible to greatly reduce the dead space in the drive chamber 15, the capacity of the drive chamber 15, the dimensions of the casing 10, and consequently the size of the entire engine E including the carburetor C equipped with the electronic control system D.

Furthermore, in order to seal the board 50 on which various types of electronic components 51 to 54 are mounted, the synthetic resin coating 57 for covering them is formed so as to have a substantially uniform thickness along the shapes of the board 50 and the various types of electronic components 51 to 54, providing no wasteful thick part. Therefore, the staggered arrangement of the first and second electric motors 20 and 21 and the large electronic components 51 to 53 is not hindered, thus contributing to downsizing of the casing 10.

Figure 16:
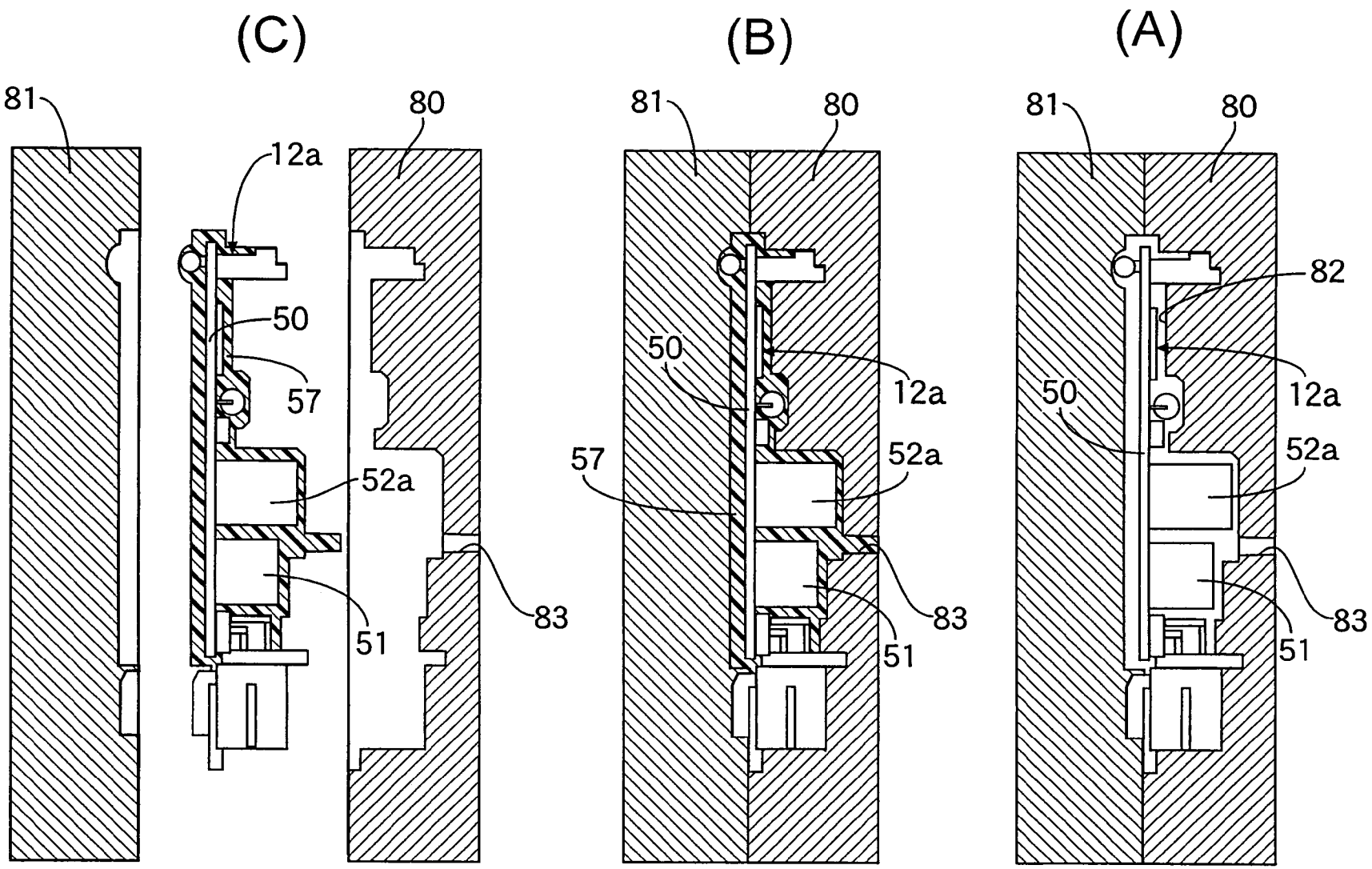
FIGS. 16A-16C are diagrams for explaining a method for forming a coating on the electronic control unit. (first embodiment)

A process of forming the coating 57 is described here by reference to FIG. 16.

When forming the coating 57 by hot melt molding, a fixed die half 80 and a movable die half 81 which can open and close relative to each other are prepared in the first place, as shown in FIG. 16(A); the movable die half 81 is opened, and the board 50 on which the various types of electronic components 51 to 54 are mounted is placed at a fixed position between the two die halves 80 and 81; and the movable die half 81 is then closed relative to the fixed die half 80. In this process, a cavity 82 having a uniform gap is formed between the two die halves 80 and 81, and the board 50 and the various types of electronic components 51 to 54.

As shown in FIG. 16(B), by injecting a heated molten hot melt from a gate 83 of the fixed die half 80 so as to fill the cavity 82 with the hot melt, the coating 57 formed from the hot melt and having a uniform thickness can be formed on the surfaces of the board 50 and the various types of electronic components 51 to 54.

When the holt melt injected so as to fill the cavity 82 is cooled by the two die halves 80 and 81 to be solidified as shown in FIG. 16(C), the movable die half 81 is opened, and the electronic control unit 12*a* equipped with the coating 57 is removed from between the two die halves 80 and 81.

Finally, a modified example of the air passage structure within the casing 10 is described by reference to FIG. 18 and FIG. 19.

A flange part 84 formed on an end part of the carburetor C on the upstream side is fixed by a connecting bolt 86 and connected, together with an intake duct 91 communicating with an air cleaner (not illustrated), to the cylinder head 3*a* of the engine E via an annular insulator 85. The intake path 6 of the carburetor C communicates with an intake port 87 of the cylinder head 3*a* via a hollow part of the insulator 85. In this arrangement, gaskets 88 are disposed between the insulator 85, and the flange part 84 and the cylinder head 3*a*.

A labyrinth 89 having its outer end facing downward so as to open to the atmosphere is formed on the flange part 84 and one opposing face of the insulator 85 (an end face on the flange part side in the illustrated example). A vent 90 providing communication between the labyrinth and the base part of the interior of the casing 10 is provided in an upper side wall of the carburetor C.

In this way, since the interior of the casing 10 communicates with the atmosphere via the vent 90 and the labyrinth 89, the interior of the casing 10 can breathe therethrough. Further, the labyrinth 89 having the opened outer end facing downward does not easily allow rainwater or dust to enter. Even if the rainwater or dust enters, it naturally flows down to be discharged to the outside.

Figure 18:
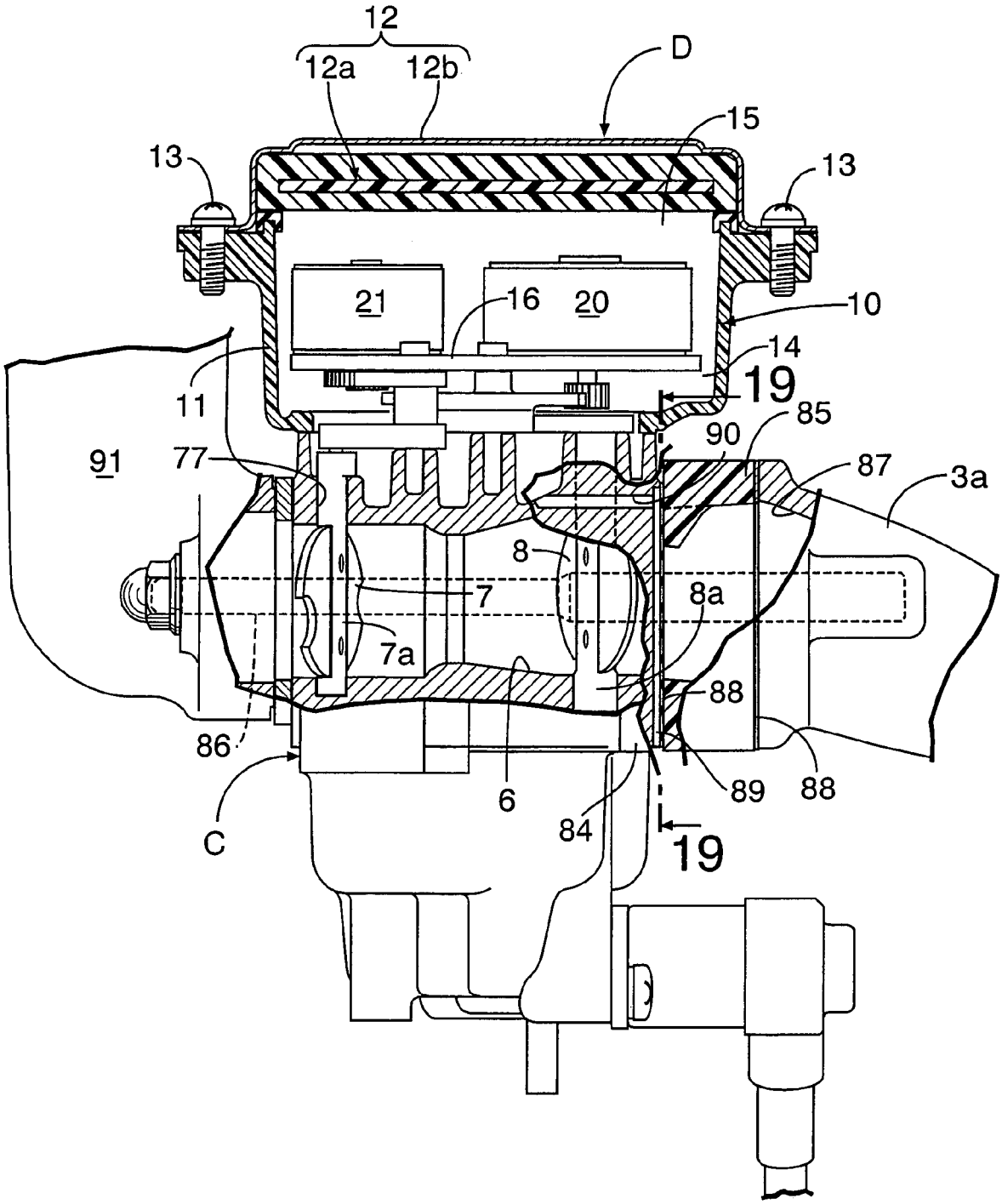
FIG. 18 is a view, corresponding to FIG. 17, showing a modified example of an air passage structure within a casing. (first embodiment)
Figure 19:
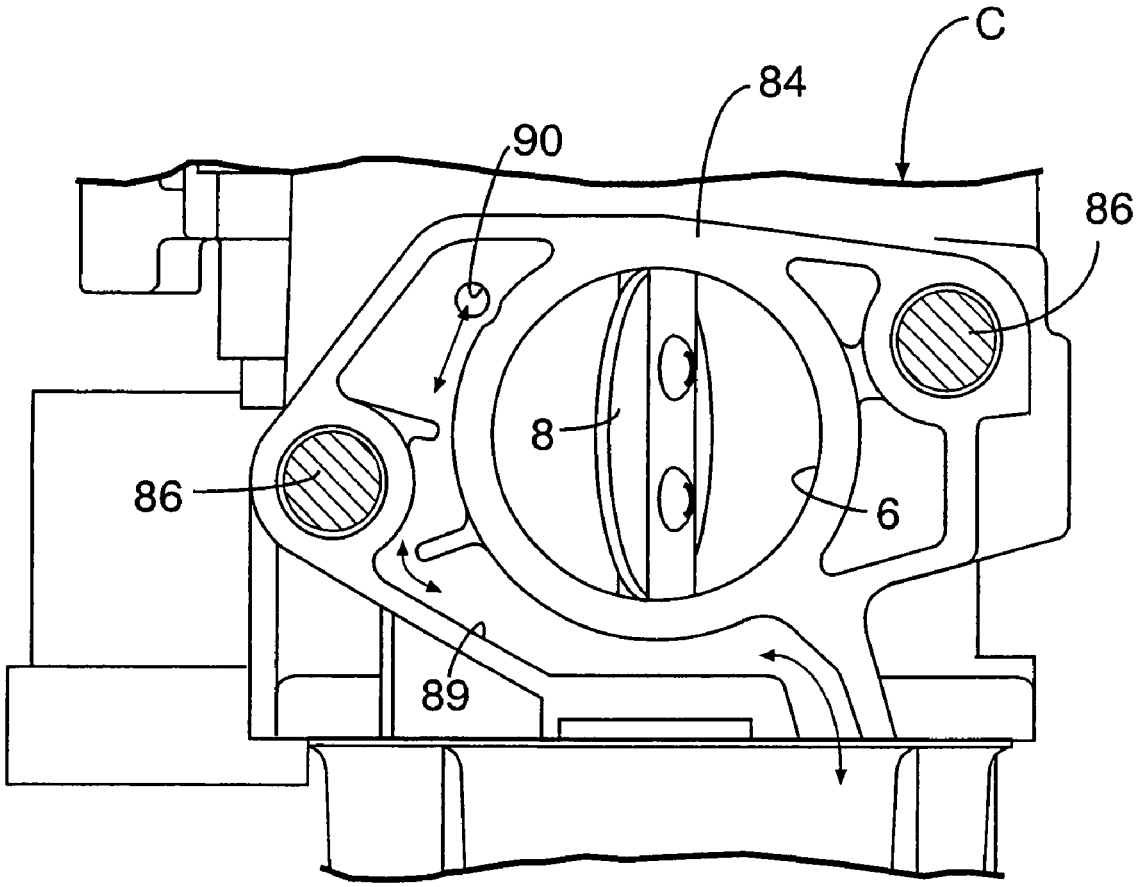
FIG. 19 is a sectional view along line 19-19 in FIG. 18. (first embodiment)

Since the other components are the same as those of the present embodiment, components in FIG. 18 and FIG. 19 corresponding to those of the present embodiment are denoted by the same reference numerals and symbols, and description thereof is omitted.

The present invention is not limited to the above-mentioned embodiment and can be modified in a variety of ways without departing from the scope of the present invention. For example, the labyrinth 89 may be formed in one of mating faces of the carburetor C and the intake duct 91.

The invention claimed is:

1. An electronic control system for a carburetor, comprising:

a transmission device linked to a valve disposed in an intake path of the carburetor, the valve configured to open and close the intake path;

an electric actuator for opening and closing the valve via the transmission device; and an electronic control unit for controlling operation of the electric actuator, the transmission device disposed between the intake path and the electric actuator, wherein the transmission device, the electric actuator and the electronic control unit are housed and held in a casing mounted on the carburetor; and wherein ventilation means for causing an interior of the casing to communicate with an outside atmosphere relative to the carburetor is connected to the casing.

2. The electronic control system for a carburetor according to claim 1, wherein the casing comprises a casing main body mounted on the carburetor and housing the transmission device and the electric actuator, and a lid body for closing an open surface of the casing main body; the lid body comprises a cover connected to the casing main body, and the electronic control unit sandwiched between the cover and the casing main body; and a gap is provided between opposed surfaces of the cover and the electronic control unit so that the gap communicates with the atmosphere through the ventilation means.

3. The electronic control system for a carburetor according to claim 2, wherein the ventilation means further comprises an air passage extending in the shape of a hook from the gap and opening to the atmosphere with its outer end facing downward.

4. The electronic control system for a carburetor according to claim 2, wherein the electronic control unit comprises a board on which an electronic control circuit is provided by print-wiring and which is arranged to close the open surface of the casing main body, and various types of electronic components mounted on a surface of the board facing an interior of the casing main body.

5. The electronic control system for a carburetor according to claim 4, wherein a hot-melt coating is formed on the surfaces of the board and the various types of electronic components to cover them.

6. The electronic control system for a carburetor according to claim 1, wherein the ventilation means is connected to a base part of the interior of the casing.

7. The electronic control system for a carburetor according to claim 6, wherein the ventilation means comprises at least one vent bored in the carburetor and causing the base part of the interior of the casing to communicate with the intake path of the carburetor.

8. The electronic control system for a carburetor according to claim 7, wherein an outer end of the at least one vent opens to a bearing hole of the carburetor supporting a choke valve shaft.

9. The electronic control system for a carburetor according to claim 6, wherein at least a part of the ventilation means comprises a labyrinth which is formed on opposed surfaces of the carburetor and an adjacent member joined thereto and which is opened to the atmosphere with its outer end facing downward.

10. An electronic control system for a carburetor, comprising:

a transmission device linked to a valve disposed in an intake path of the carburetor, the valve configured to open and close the intake path;

an electric actuator for opening and closing the valve via the transmission device; and an electronic control unit for controlling operation of the electric actuator, the transmission device disposed between the intake path and the electric actuator, wherein the transmission device, the electric actuator and the electronic control unit are housed and held in a casing mounted on the carburetor;

wherein ventilation means, which places an interior of the casing in communication with an outside atmosphere relative to the carburetor, is connected to a base part of the interior of the casing, the ventilation means comprises at least one vent bored in the carburetor and which cause the base part of the interior of the casing to communicate with the intake path of the carburetor, and wherein an outer end of the at least one vent opens to a bearing hole of the carburetor supporting a choke valve shaft.

11. The electronic control system for a carburetor according to claim 10, wherein the casing comprises a casing main body mounted on the carburetor and houses the transmission device and the electric actuator, and a lid body for closing an open surface of the casing main body; the lid body comprises a cover connected to the casing main body, and the electronic control unit sandwiched between the cover and the casing main body; and a gap is provided between opposed surfaces of the cover and the electronic control unit so that the gap communicates with the atmosphere through the ventilation means.

12. The electronic control system for a carburetor according to claim 11, wherein the ventilation means further comprises an air passage extending in the shape of a hook from the gap and opening to the atmosphere with its outer end facing downward.

13. The electronic control system for a carburetor according to claim 10, wherein the electronic control unit comprises a board on which an electronic control circuit is provided by print-wiring and which is arranged to close the open surface of the casing main body, and various types of electronic components mounted on a surface of the board facing an interior of the casing main body.

14. The electronic control system for a carburetor according to claim 13, wherein a hot-melt coating is formed on the surfaces of the board and the various types of electronic components to cover them.

15. The electronic control system for a carburetor according to claim 10, wherein at least a part of the ventilation means further comprises a labyrinth which is formed on opposed surfaces of the carburetor and an adjacent member joined thereto and which is opened to the atmosphere with its outer end facing downward.

* * * * *